US010040288B2

(12) United States Patent
Moriya et al.

(10) Patent No.: US 10,040,288 B2
(45) Date of Patent: Aug. 7, 2018

(54) LIQUID EJECTION MODULE AND LIQUID EJECTION HEAD

(71) Applicant: CANON KABUSHIKI KAISHA, Tokyo (JP)

(72) Inventors: Takatsugu Moriya, Tokyo (JP); Shintaro Kasai, Yokohama (JP); Yoshiyuki Nakagawa, Kawasaki (JP); Akiko Saito, Tokyo (JP); Koichi Ishida, Tokyo (JP); Tatsuya Yamada, Kawasaki (JP); Shuzo Iwanaga, Kawasaki (JP); Ayako Tozuka, Yokohama (JP); Tomoki Ishiwata, Kawasaki (JP); Tomohiro Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/889,533

(22) Filed: Feb. 6, 2018

(65) Prior Publication Data

US 2018/0162130 A1 Jun. 14, 2018

Related U.S. Application Data

(62) Division of application No. 15/388,725, filed on Dec. 22, 2016, now Pat. No. 9,931,845.

(30) Foreign Application Priority Data

Jan. 8, 2016 (JP) ..... 2016-002999
Dec. 9, 2016 (JP) ..... 2016-239695

(51) Int. Cl.
*B41J 2/155* (2006.01)
*B41J 2/18* (2006.01)

(52) U.S. Cl.
CPC *B41J 2/155* (2013.01); *B41J 2/18* (2013.01)

(58) Field of Classification Search
CPC ..... B41J 2/18; B41J 2/155
See application file for complete search history.

(56) References Cited

U.S. PATENT DOCUMENTS 5,818,485 A * 10/1998 Rezanka ..... B41J 2/175 347/89
6,652,702 B2 11/2003 Miyazaki et al.
6,659,591 B2 12/2003 Sato et al.
6,749,287 B2 6/2004 Osada et al.
7,591,531 B2 9/2009 Tsuchii et al.
7,690,767 B2 4/2010 Hirosawa et al.
7,775,638 B2 8/2010 Hirosawa et al.
7,789,499 B2 9/2010 Iwanaga et al.
7,845,763 B2 12/2010 Kenshishian et al.
7,980,676 B2 7/2011 Hirosawa et al.
8,177,330 B2 5/2012 Suganuma et al.
8,201,925 B2 6/2012 Saito et al.
8,662,642 B2 3/2014 Komamiya et al.
(Continued)

*Primary Examiner* — Juanita D Jackson
(74) *Attorney, Agent, or Firm* — Fitzpatrick, Cella, Harper & Scinto

(57) ABSTRACT

A liquid ejection module and a liquid ejection head capable of suppressing unevenness in printing are provided. Accordingly, openings are disposed so that a center position of at least one of openings in a plurality of ejection opening rows is not disposed on the same line extending in a print medium movement direction in a relative movement with respect to center positions of the other openings.

20 Claims, 36 Drawing Sheets

(56) References Cited

U.S. PATENT DOCUMENTS

| | | | | |
|---|---|---|---|---|
| 8,746,847 | B2 | 6/2014 | Kishikawa et al. | |
| 9,126,409 | B2 | 9/2015 | Tamenaga et al. | |
| 9,221,257 | B2 | 12/2015 | Moriya et al. | |
| 9,248,647 | B2 | 2/2016 | Iwanaga et al. | |
| 9,254,658 | B2 | 2/2016 | Yamada et al. | |
| 9,469,111 | B2 | 10/2016 | Yamada et al. | |
| 9,539,808 | B2 | 1/2017 | Tamenaga et al. | |
| 2012/0113197 | A1* | 5/2012 | Kashu | B41J 2/1404 347/89 |
| 2012/0200649 | A1 | 8/2012 | Igawa et al. | |
| 2015/0239238 | A1 | 8/2015 | Yamada et al. | |
| 2017/0197419 | A1 | 7/2017 | Okushima et al. | |
| 2017/0197439 | A1 | 7/2017 | Okushima et al. | |

* cited by examiner

LIQUID EJECTION MODULE AND LIQUID EJECTION HEAD

BACKGROUND OF THE INVENTION

Field of the Invention

The present invention relates to a liquid ejection module and a liquid ejection head used to eject a liquid such as ink.

Description of the Related Art

In a recent inkjet printing apparatus, liquid ejection elements are densely provided in a liquid ejection head in order to print a high-quality image at a higher speed. In such a liquid ejection head, since passages are densely arranged compared with the related art, the passages are decreased in size.

When the passage is decreased in size, a flow resistance increases when the liquid flows therethrough and thus pressure loss increases. For this reason, a negative pressure at an ejection opening increases and thus a printing operation may be influenced. For example, when the negative pressure increases, a meniscus of the ejection opening is retracted toward the inside of the ejection opening and thus a liquid ejection amount becomes smaller than that of a low negative pressure state. When the liquid ejection amount is small, printing density becomes low and thus a desired result cannot be obtained.

Here, U.S. Pat. No. 7,845,763 discloses a print head assembly capable of printing an image at a high speed while suppressing pressure loss caused by a flow resistance to minimum by employing a structure in which a liquid is supplied through a large passage extending as close as possible to a print element and is supplied through a fine passage formed in the vicinity of the print element.

When the large passage is connected to the fine passage, a negative pressure is low at the ejection opening which is relatively close to the connection position, but increases as it goes away from the connection portion. In the structure disclosed in U.S. Pat. No. 7,845,763, supply openings for different ejection opening rows are provided at the same position in a print medium conveying direction. Thus, since the ejection opening having a low negative pressure and the ejection opening having a high negative pressure in each ejection opening row are located at the same position in the conveying direction, shade caused by printing density (unevenness in printing) occurs at the same position of the ejection opening row and thus the shade is emphasized and easily recognized.

SUMMARY OF THE INVENTION

Therefore, an object of the invention is to provide a liquid ejection module and a liquid ejection head capable of suppressing unevenness in printing.

In order to attain the above-described object, according to the invention, there is provided a liquid ejection module that includes a print element board ejecting a liquid from an ejection opening to a relatively moving print medium, wherein the ejection opening communicates with a passage provided in the print element board, wherein a plurality of the ejection openings are provided along the passage and form an ejection opening row extending in a direction intersecting a print medium movement direction in a relative movement, wherein the print element board provided with a plurality of the ejection opening rows includes the passage corresponding to each of the ejection opening rows and a plurality of openings communicating with the passages, and wherein a center position of at least one of the openings is provided to be deviated from the same line extending in the print medium movement direction in the relative movement with respect to center positions of the other openings.

According to the invention, a liquid ejection module and a liquid ejection head capable of suppressing unevenness in printing can be realized.

Further features of the present invention will become apparent from the following description of exemplary embodiments (with reference to the attached drawings).

DESCRIPTION OF THE EMBODIMENTS

Hereinafter, first and second application examples of the invention will be described with reference to the drawings.

First Application Example (Description of Inkjet Printing Apparatus)

Figure 1:
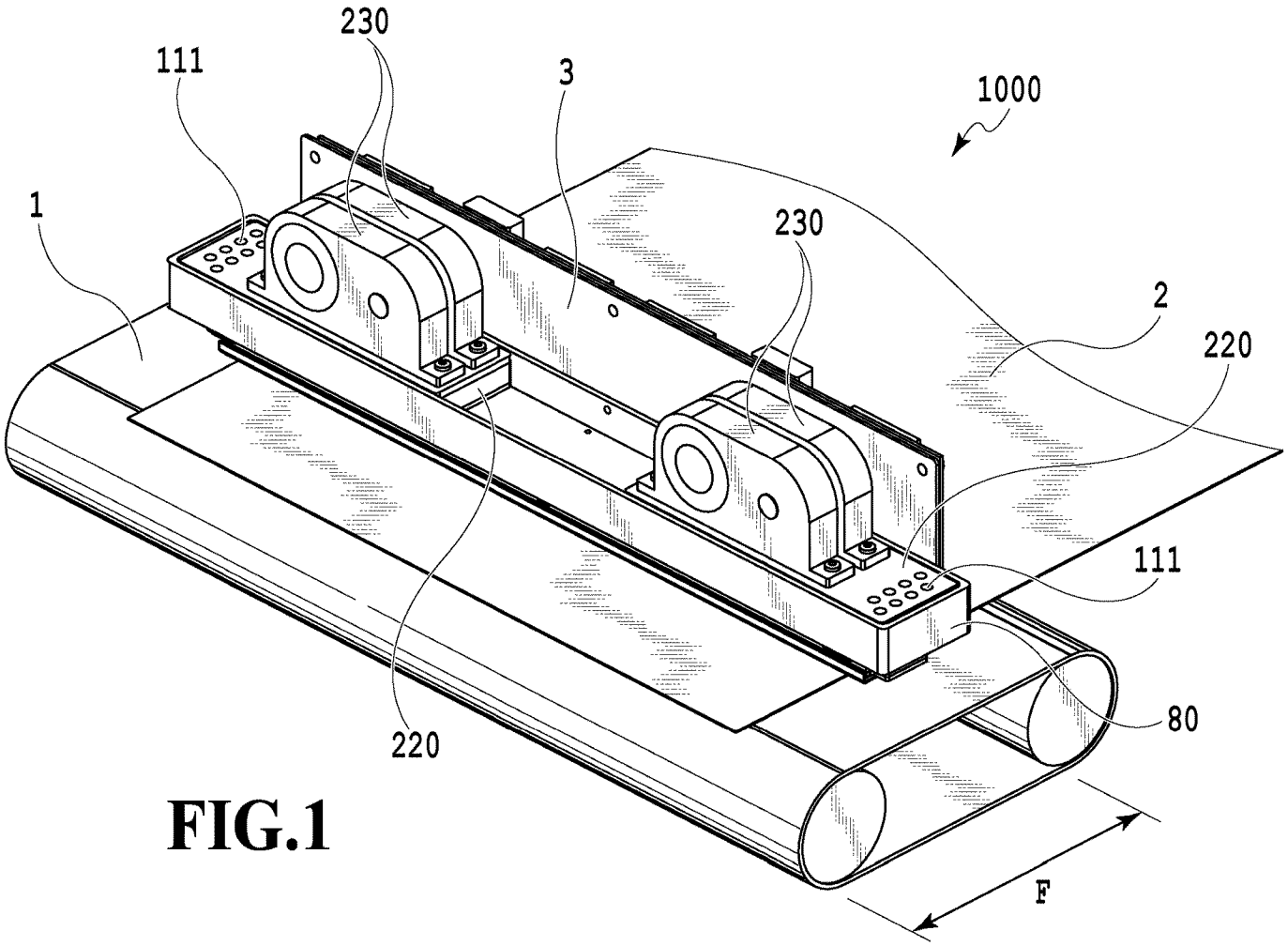
FIG. 1 is a diagram illustrating a schematic configuration of a liquid ejection apparatus that ejects a liquid.

FIG. 1 is a diagram illustrating a schematic configuration of a liquid ejection apparatus that ejects a liquid in the invention and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 includes a negative pressure control unit 230 which controls a pressure (a negative pressure) inside a circulation path, a liquid supply unit 220 which communicates with the negative pressure control unit 230 so that a fluid can flow therebetween, a liquid connection portion 111 which serves as an ink supply opening and an ink discharge opening of the liquid supply unit 220, and a casing 80. The print medium 2 is not limited to a cut sheet and may be also a continuous roll medium.

The liquid ejection head 3 can print a full color image by inks of cyan C, magenta M, yellow Y, and black K and is fluid-connected to a liquid supply member, a main tank, and a buffer tank (see FIG. 2 to be described later) which serve as a supply path supplying a liquid to the liquid ejection head 3. Further, the control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The circulation mode includes a first circulation mode in which the liquid is circulated by the activation of two circulation pumps (for high and low pressures) at the downstream side of the liquid ejection head 3 and a second circulation mode in which the liquid is circulated by the activation of two circulation pumps (for high and low pressures) at the upstream side of the liquid ejection head 3. Hereinafter, the first circulation mode and the second circulation mode of the circulation will be described.

(Description of First Circulation Mode)

Figure 2:
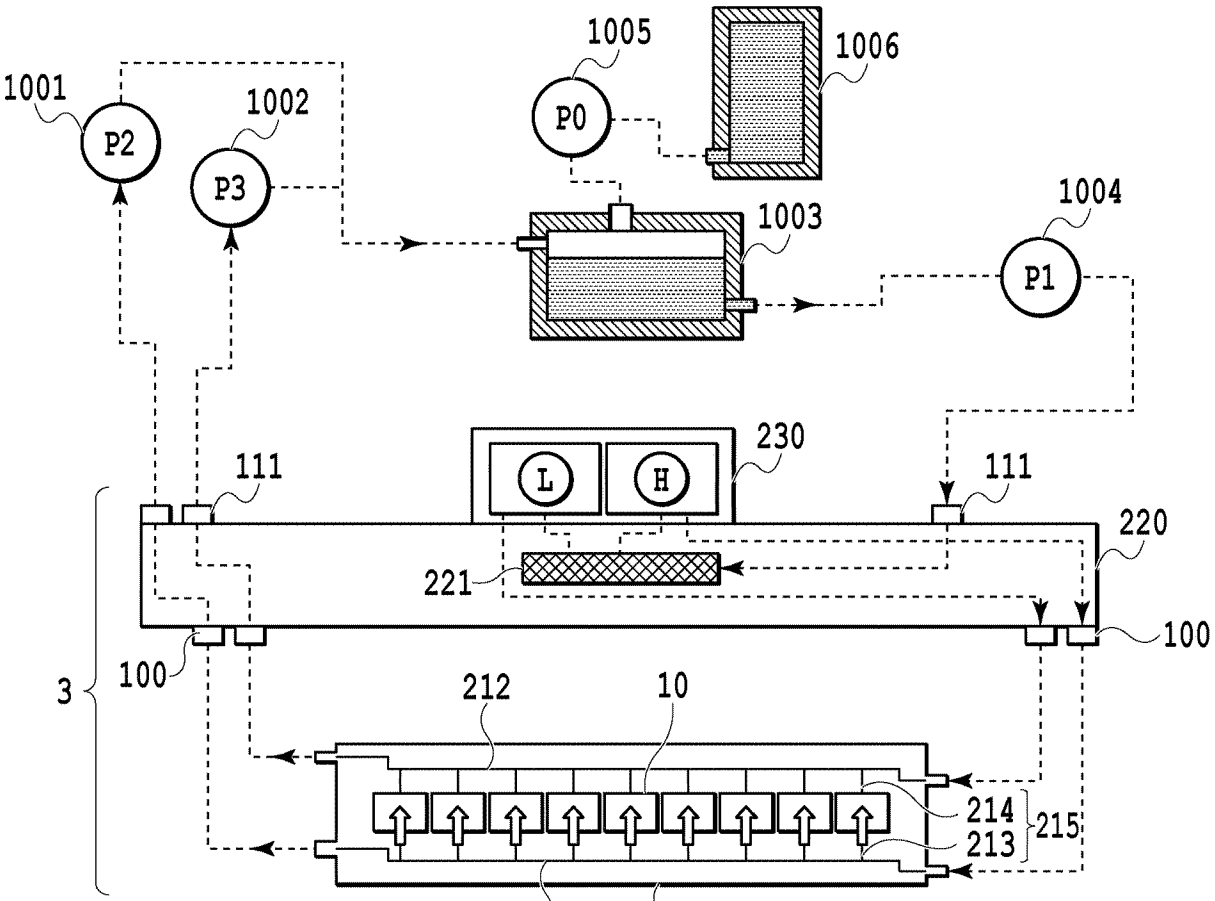
FIG. 2 is a schematic diagram illustrating a first circulation mode in a circulation path applied to a printing apparatus.

FIG. 2 is a schematic diagram illustrating the first circulation mode in the circulation path applied to the printing apparatus 1000 of the application example. The liquid ejection head 3 is fluid-connected to a first circulation pump (the high pressure side) 1001, a first circulation pump (the low pressure side) 1002, and a buffer tank 1003. Further, in FIG. 2, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the first circulation mode, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 connected to the liquid supply unit 220 is circulated while being divided into two passages having the high and low pressures. The ink inside the liquid ejection head 3 is circulated in the liquid ejection head by the action of the first circulation pump (the high pressure side) 1001 and the first circulation pump (the low pressure side) 1002 at the downstream side of the liquid ejection head 3, is discharged from the liquid ejection head 3 through the liquid connection portion 111, and is returned to the buffer tank 1003.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction collection operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during a printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality.

Above all, when a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even when the flow rate of the ink changes in the circulation system due to a difference in ejection amount per unit area. As two negative pressure control mechanisms constituting the negative pressure control unit 230, any mechanism may be used as long as a pressure at the downstream side of the negative pressure control unit 230 can be controlled within a predetermined range or less from a desired set pressure.

As an example, a mechanism such as a so-called "pressure reduction regulator" can be employed. In the circulation passage of the application example, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004. As illustrated in FIG. 2, the negative pressure control unit 230 includes two negative pressure adjustment mechanisms respectively having different control pressures. Among two negative pressure adjustment mechanisms, a relatively high pressure side (indicated by "H" in FIG. 2) and a relatively low pressure side (indicated by "L" in FIG. 2) are respectively connected to the common supply passage 211 and the common collection passage 212 inside the liquid ejection unit 300 through the liquid supply unit 220.

The liquid ejection unit 300 is provided with the common supply passage 211, the common collection passage 212, and an individual passage 215 (an individual supply passage 213 and an individual collection passage 214) communicating with the print element board. The negative pressure control mechanism H is connected to the common supply passage 211, the negative pressure control mechanism L is connected to the common collection passage 212, and a differential pressure is formed between two common passages. Then, since the individual passage 215 communicates with the common supply passage 211 and the common collection passage 212, a flow (a flow indicated by an arrow direction of FIG. 2) is generated in which a part of the liquid flows from the common supply passage 211 to the common collection passage 212 through the passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be discharged toward the common collection passage 212. For this reason, the liquid ejection head 3 of the application example can print a high-quality image at a high speed.

(Description of Second Circulation Mode)

Figure 3:
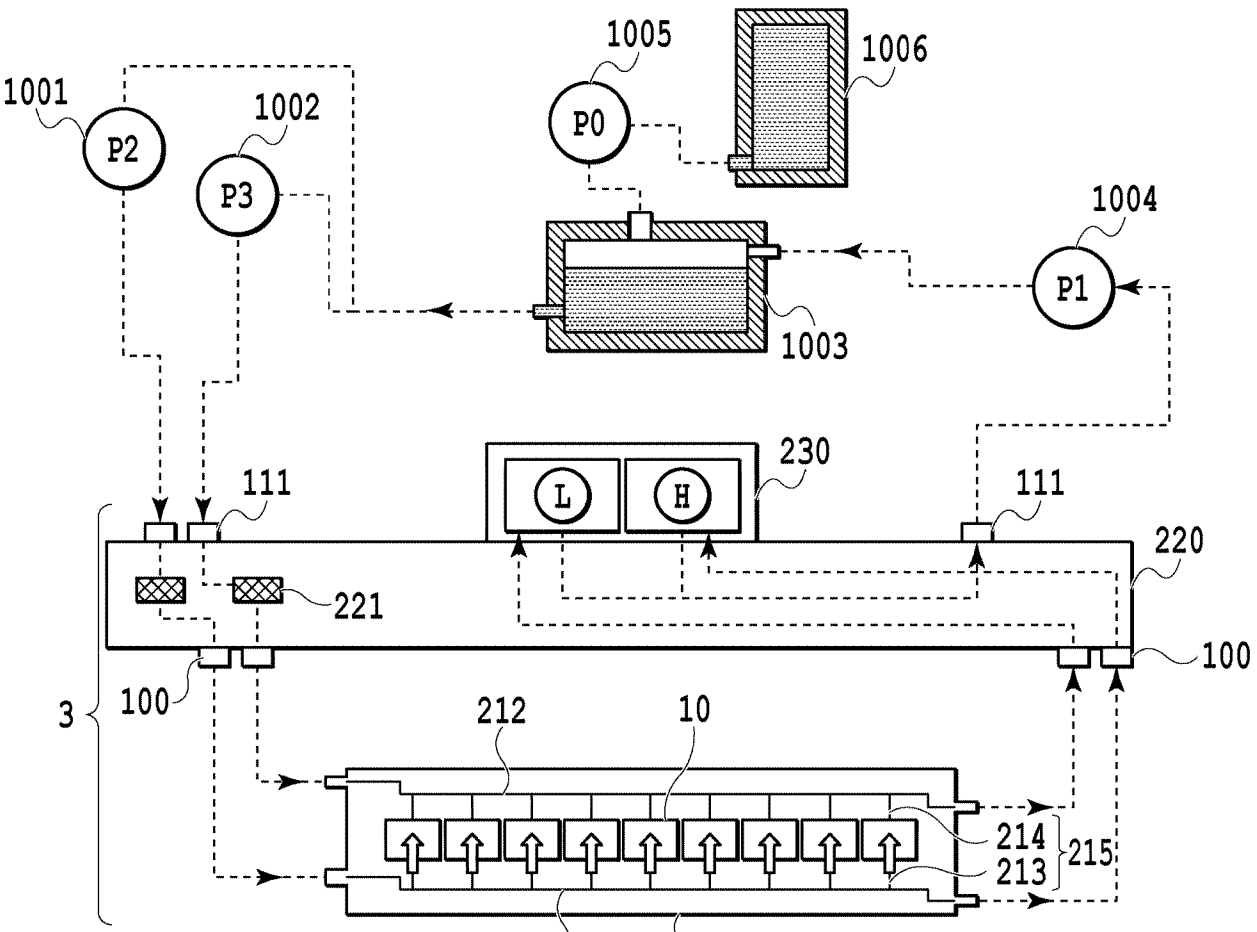
FIG. 3 is a schematic diagram illustrating a second circulation mode in the circulation path applied to the printing apparatus.

FIG. 3 is a schematic diagram illustrating the second circulation mode which is a circulation mode different from the first circulation mode in the circulation path applied to the printing apparatus of the application example. A main difference from the first circulation mode is that two negative pressure control mechanisms constituting the negative pressure control unit 230 both control a pressure at the upstream side of the negative pressure control unit 230 within a predetermined range from a desired set pressure. Further, another difference from the first circulation mode is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation mode, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the negative pressure control unit 230. The discharged ink is returned to the buffer tank 1003 by the second circulation pump 1004.

In the second circulation mode, the negative pressure control unit 230 stabilizes a change in pressure at the upstream side (that is, the liquid ejection unit 300) of the negative pressure control unit 230 within a predetermined range from a predetermined pressure even when a change in flow rate is caused by a change in ejection amount per unit area. In the circulation passage of the application example, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options.

Instead of the second circulation pump 1004, for example, a water head tank disposed to have a predetermined water head difference with respect to the negative pressure control unit 230 can be also used. Similarly to the first circulation mode, in the second circulation mode, the negative pressure control unit 230 includes two negative pressure control mechanisms respectively having different control pressures. Among two negative pressure adjustment mechanisms, a high pressure side (indicated by "H" in FIG. 3) and a low pressure side (indicated by "L" in FIG. 3) are respectively connected to the common supply passage 211 or the common collection passage 212 inside the liquid ejection unit 300 through the liquid supply unit 220. When the pressure of the common supply passage 211 is set to be higher than the pressure of the common collection passage 212 by two negative pressure adjustment mechanisms, a flow of the liquid is formed from the common supply passage 211 to the common collection passage 212 through the individual passage 215 and the passages formed inside the print element boards 10.

In such a second circulation mode, the same liquid flow as that of the first circulation mode can be obtained inside the liquid ejection unit 300, but the second circulation mode has two advantages different from those of the first circulation mode. As a first advantage, in the second circulation mode, since the negative pressure control unit 230 is disposed at the downstream side of the liquid ejection head 3, there is low concern that foreign material or trash produced from the negative pressure control unit 230 flows into the liquid ejection head 3. As a second advantage, in the second circulation mode, a maximal value of the flow rate necessary for the liquid from the buffer tank 1003 to the liquid ejection head 3 is smaller than that of the first circulation mode. The reason is as below.

In the case of the circulation in the print standby state, the sum of the flow rates of the common supply passage 211 and the common collection passage 212 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained when the ink is ejected from all ejection openings of the liquid ejection unit 300 (the full ejection state) is defined as a flow rate F (the ejection amount per each ejection opening×the ejection frequency per unit time×the number of the ejection openings).

Figure 4:
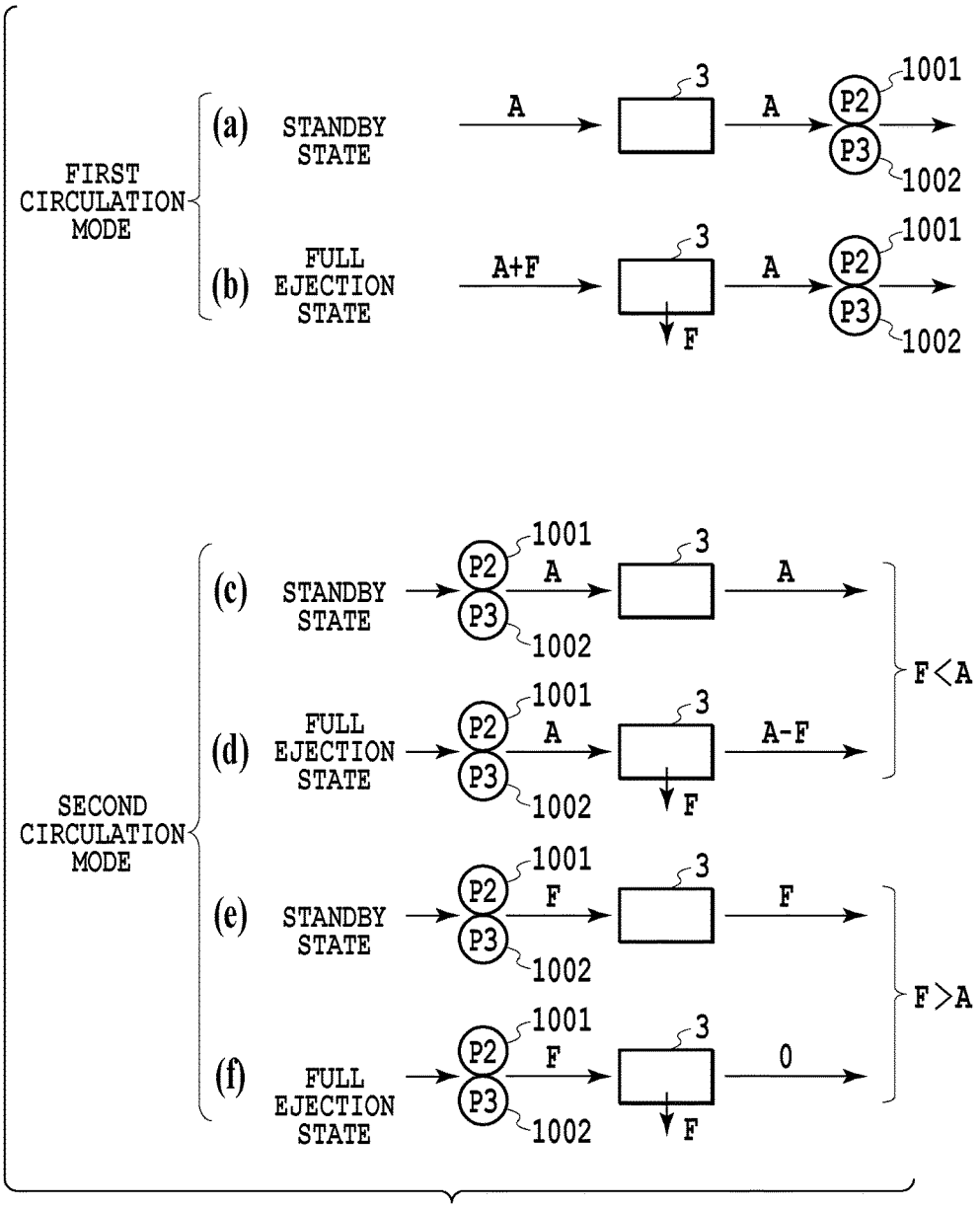
FIG. 4 is a schematic diagram illustrating a difference in ink inflow amount to a liquid ejection head.

FIG. 4 is a schematic diagram illustrating a difference in ink inflow amount to the liquid ejection head 3 between the first circulation mode and the second circulation mode. Part (a) of FIG. 4 illustrates the standby state in the first circulation mode and part (b) of FIG. 4 illustrates the full ejection state in the first circulation mode. Parts (c) to (f) of FIG. 4 illustrate the second circulation passage. Here, parts (c) and (d) of FIG. 4 illustrate a case where the flow rate F is lower than the flow rate A and parts (e) and (f) of FIG. 4 illustrate a case where the flow rate F is higher than the flow rate A. In this way, the flow rates in the standby state and the full ejection state are illustrated.

In the case of the first circulation mode (parts (a) and (b) of FIG. 4) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes the flow rate A. By the flow rate A, the temperature inside the liquid ejection unit 300 in the standby state can be managed. Then, in the case of the full ejection state of the liquid ejection head 3, the total flow rate of the first circulation pump 1001 and the first circulation pump 1002 becomes the flow rate A. However, a maximal flow rate of the liquid supplied to the liquid ejection head 3 is obtained such that the flow rate F consumed by the full ejection is added to the flow rate A of the total flow rate by the action of the negative pressure generated by the ejection of the liquid ejection head 3. Thus, a maximal value of the supply amount to the liquid ejection head 3 satisfies a relation of the flow rate A+the flow rate F since the flow rate F is added to the flow rate A (part (b) of FIG. 4).

Meanwhile, in the case of the second circulation mode (parts (c) to (f) of FIG. 4) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation mode. Thus, when the flow rate A is higher than the flow rate F (parts (c) and (d) of FIG. 4) in the second circulation mode in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of the flow rate A−the flow rate F (part (d) of FIG. 4).

However, when the flow rate F is higher than the flow rate A (parts (e) and (f) of FIG. 4), the flow rate becomes insufficient when the flow rate of the liquid supplied to the liquid ejection head 3 becomes the flow rate A in the full ejection state. For that reason, when the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (part (f) of FIG. 4). In addition, if the liquid is not ejected in the full ejection state when the flow rate F is higher than the flow rate A, the liquid which is attracted by the amount consumed by the ejection of the flow rate F is discharged from the liquid ejection head 3. Further, when the flow rate A and the flow rate F are equal to each other, the flow rate A (or the flow rate F) is supplied to the liquid ejection head 3 and the flow rate F is consumed by the liquid ejection head 3. For this reason, the flow rate discharged from the liquid ejection head 3 becomes almost zero.

In this way, in the case of the second circulation mode, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation mode becomes smaller than the maximal value (the flow rate A+the flow rate F) of the supply flow rate necessary for the first circulation mode.

For that reason, in the case of the second circulation mode, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a long longitudinal length among the line heads is beneficial.

Meanwhile, the first circulation mode is more advantageous than the second circulation mode. That is, in the second circulation mode, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, when the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with main droplets of the ink.

Meanwhile, in the case of the first circulation mode, since a high negative pressure is applied to the ejection opening when the image (hereinafter, also referred to as a high-duty image) having a large ejection amount per unit area is formed, there is an advantage that an influence of satellite droplets on the image is small even when many satellite droplets are generated. Two circulation modes can be desirably selected in consideration of the specifications (the ejection flow rate F, the minimal circulation flow rate A, and the passage resistance inside the head) of the liquid ejection head and the printing apparatus body.

(Description of Third Circulation Mode)

Figure 29:
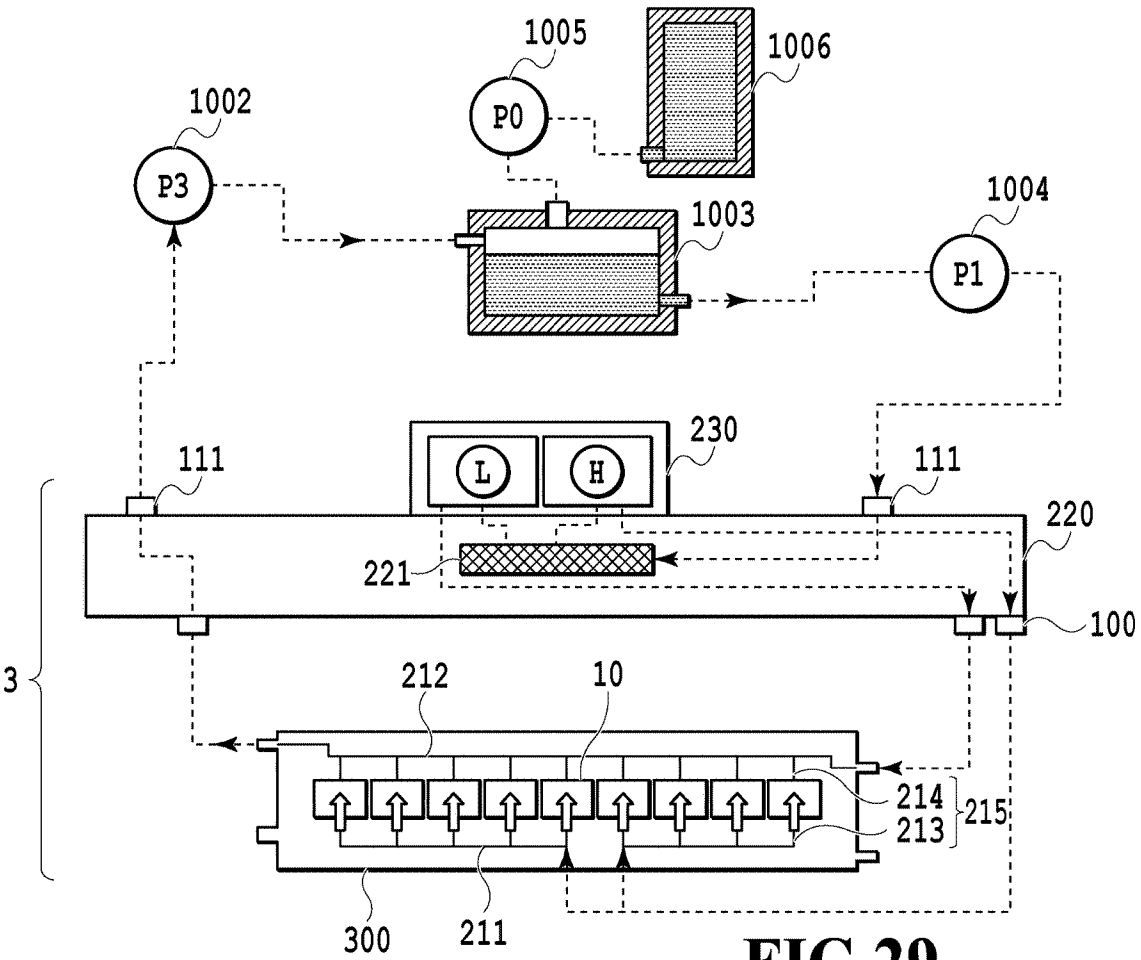
FIG. 29 is a diagram illustrating a third circulation mode.

FIG. 29 is a schematic diagram illustrating a third circulation mode which is one of the circulation paths used in the printing apparatus of the embodiment. A description of the same functions and configurations as those of the first and second circulation paths will be omitted and only a difference will be described.

In the circulation path, the liquid is supplied into the liquid ejection head 3 from three positions including two positions of the center portion of the liquid ejection head 3 and one end side of the liquid ejection head 3. The liquid flowing from the common supply passage 211 to each pressure chamber 23 is collected by the common collection passage 212 and is collected to the outside from the collection opening at the other end of the liquid ejection head 3. The individual supply passage 213 communicates with the common supply passage 211 and the common collection passage 212 and the print element board 10 and the pressure chamber 23 disposed inside the print element board are provided in the path of the individual supply passage 213. Accordingly, a part of the liquid flowing from the first circulation pump 1002 flows from the common supply passage 211 to the common collection passage 212 while passing through the pressure chamber 23 of the print element board 10 and flows (see an arrow of FIG. 29). This is because a differential pressure is generated between a pressure adjustment mechanism H connected to the common supply passage 211 and a pressure adjustment mechanism L connected to the common collection passage 212 and the first circulation pump 1002 is connected only to the common collection passage 212.

In this way, in the liquid ejection unit 300, a flow of the liquid passing through the common collection passage 212 and a flow of the liquid flowing from the common supply passage 211 to the common collection passage 212 while passing through the pressure chamber 23 inside each print element board 10 are generated. For this reason, heat generated by each print element board 10 can be discharged to the outside of the print element board 10 by the flow from the common supply passage 211 to the common collection passage 212 while pressure loss is suppressed. Further, according to the circulation path, the number of the pumps which are liquid transporting units can be decreased compared with the first and second circulation paths.

(Description of Configuration of Liquid Ejection Head)

Figure 5A:
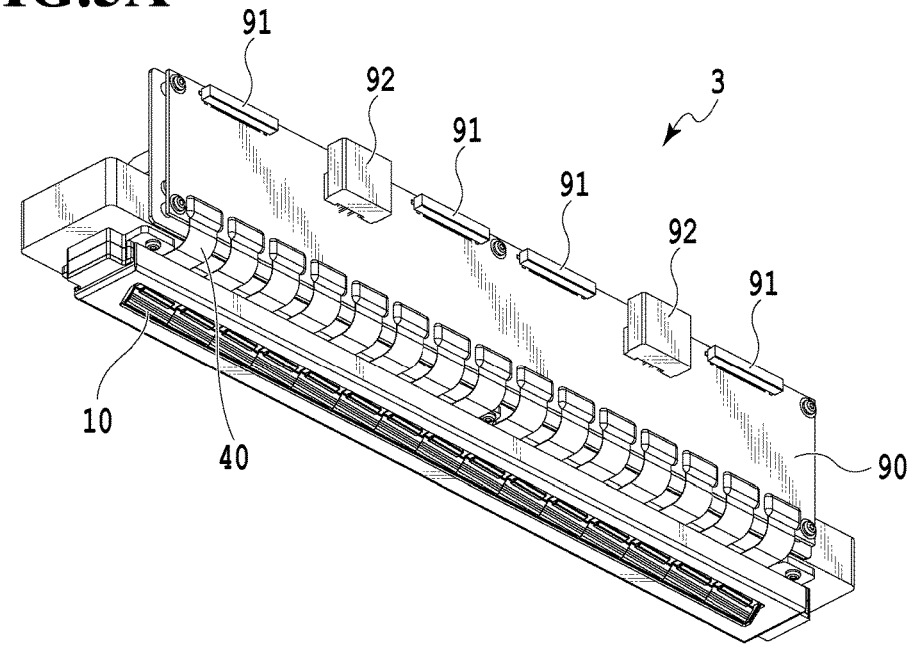
FIG. 5A is a perspective view illustrating the liquid ejection head.
Figure 5B:
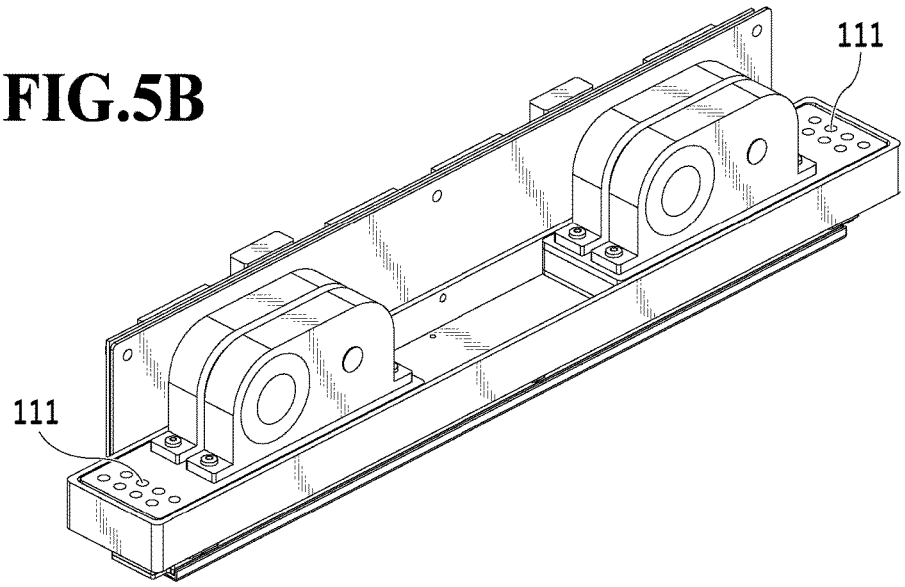
FIG. 5B is a perspective view illustrating the liquid ejection head.

A configuration of the liquid ejection head 3 according to the first application example will be described. FIGS. 5A and 5B are perspective views illustrating the liquid ejection head 3 according to the application example. The liquid ejection head 3 is a line type liquid ejection head in which fifteen print element boards 10 capable of ejecting inks of four colors of cyan C, magenta M, yellow Y, and black K are arranged in series on one print element board 10 (an in-line arrangement). As illustrated in FIG. 5A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10.

The signal input terminal 91 and the power supply terminal 92 are electrically connected to the control unit of the printing apparatus 1000 so that an ejection drive signal and power necessary for the ejection are supplied to the print element board 10. When the wirings are integrated by the electric circuit inside the electric wiring board 90, the number of the signal input terminals 91 and the power supply terminals 92 can be decreased compared with the number of the print element boards 10. Accordingly, the number of electrical connection components to be separated when the liquid ejection head 3 is assembled to the printing apparatus 1000 or the liquid ejection head is replaced decreases.

As illustrated in FIG. 5B, the liquid connection portions 111 which are provided at both ends of the liquid ejection head 3 are connected to the liquid supply system of the printing apparatus 1000. Accordingly, the inks of four colors including cyan C, magenta M, yellow Y, and black K are supplied from the supply system of the printing apparatus 1000 to the liquid ejection head 3 and the inks passing through the liquid ejection head 3 are collected by the supply system of the printing apparatus 1000. In this way, the inks of different colors can be circulated through the path of the printing apparatus 1000 and the path of the liquid ejection head 3.

Figure 6:
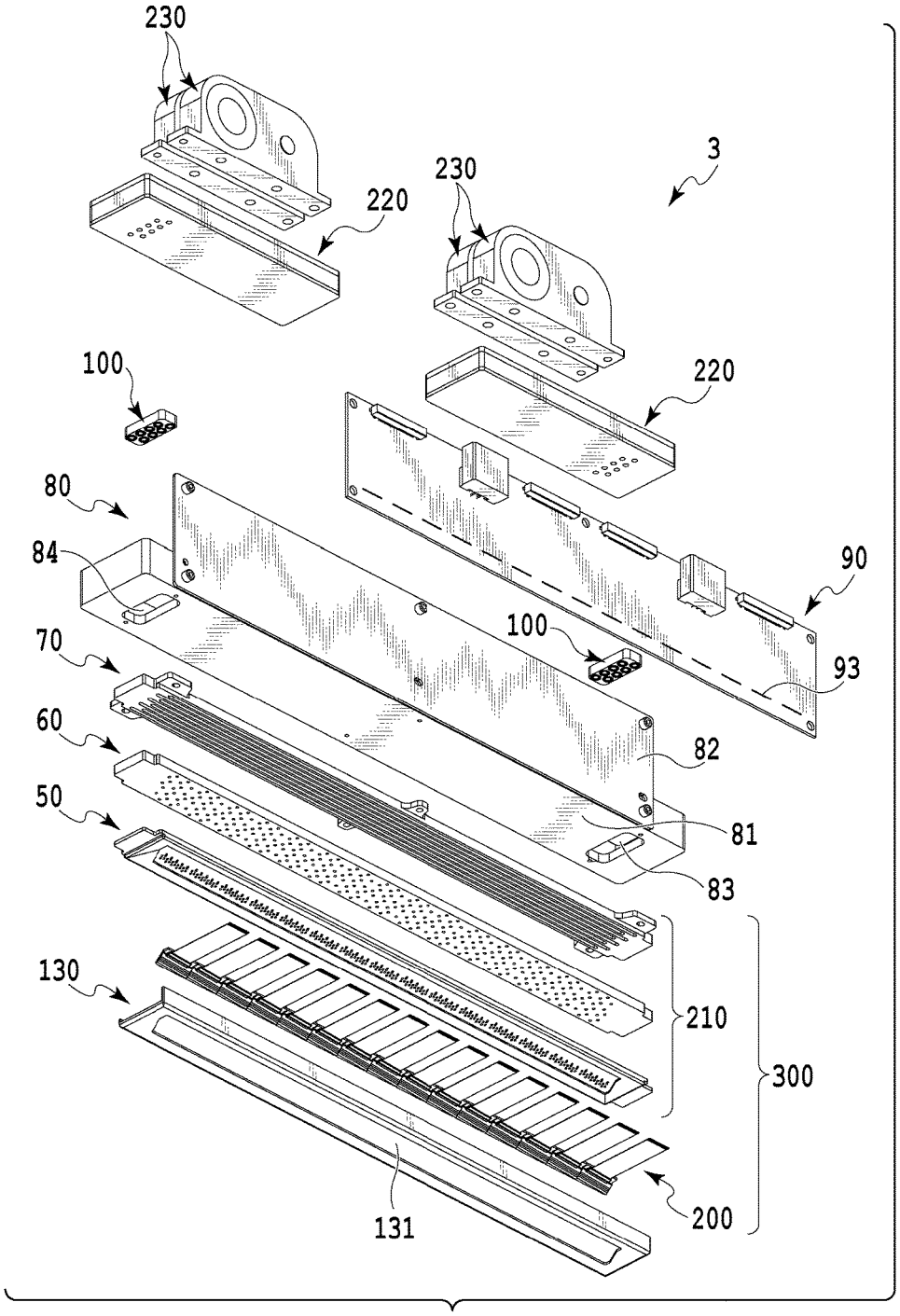
FIG. 6 is an exploded perspective view illustrating components or units constituting the liquid ejection head.

FIG. 6 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 3) are provided in the liquid supply unit 220. Also, in order to remove a foreign material in the supplied ink, filters 221 (see FIGS. 2 and 3) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the negative pressure control unit 230 disposed on the liquid supply unit 220 disposed to correspond to each color.

The negative pressure control unit 230 is a unit which includes different colors of negative pressure control valves. By the function of a spring member or a valve provided therein, a change in pressure loss inside the supply system (the supply system at the upstream side of the liquid ejection head 3) of the printing apparatus 1000 caused by a change in flow rate of the liquid is largely decreased. Accordingly, the negative pressure control unit 230 can stabilize a change in negative pressure at the downstream side (the liquid ejection unit 300 side) of the negative pressure control unit 230 within a predetermined range. As described in FIG. 2, two negative pressure control valves of different colors are built inside the negative pressure control unit 230. Two negative pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed.

For that reason, it is desirable that the liquid ejection unit support portion 81 have sufficient rigidity. As a material, metal such as SUS or aluminum or ceramic such as alumina is desirable. The liquid ejection unit support portion 81 is provided with openings 83 and 84 into which a joint rubber 100 is inserted. The liquid supplied from the liquid supply unit 220 is led to a third passage member 70 constituting the liquid ejection unit 300 through the joint rubber.

The liquid ejection unit 300 includes a plurality of ejection modules 200 and a passage member 210 and a cover member 130 is attached to a face near the print medium in the liquid ejection unit 300. Here, the cover member 130 is a member having a picture frame shaped surface and provided with an elongated opening 131 as illustrated in FIG. 6 and the print element board 10 and a sealing member 110 (see FIG. 10A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 6, the passage member 210 is obtained by laminating a first passage member 50, a second passage member 60, and a third passage member 70 and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus the warpage or deformation of the passage member 210 is suppressed.

Figure 7:
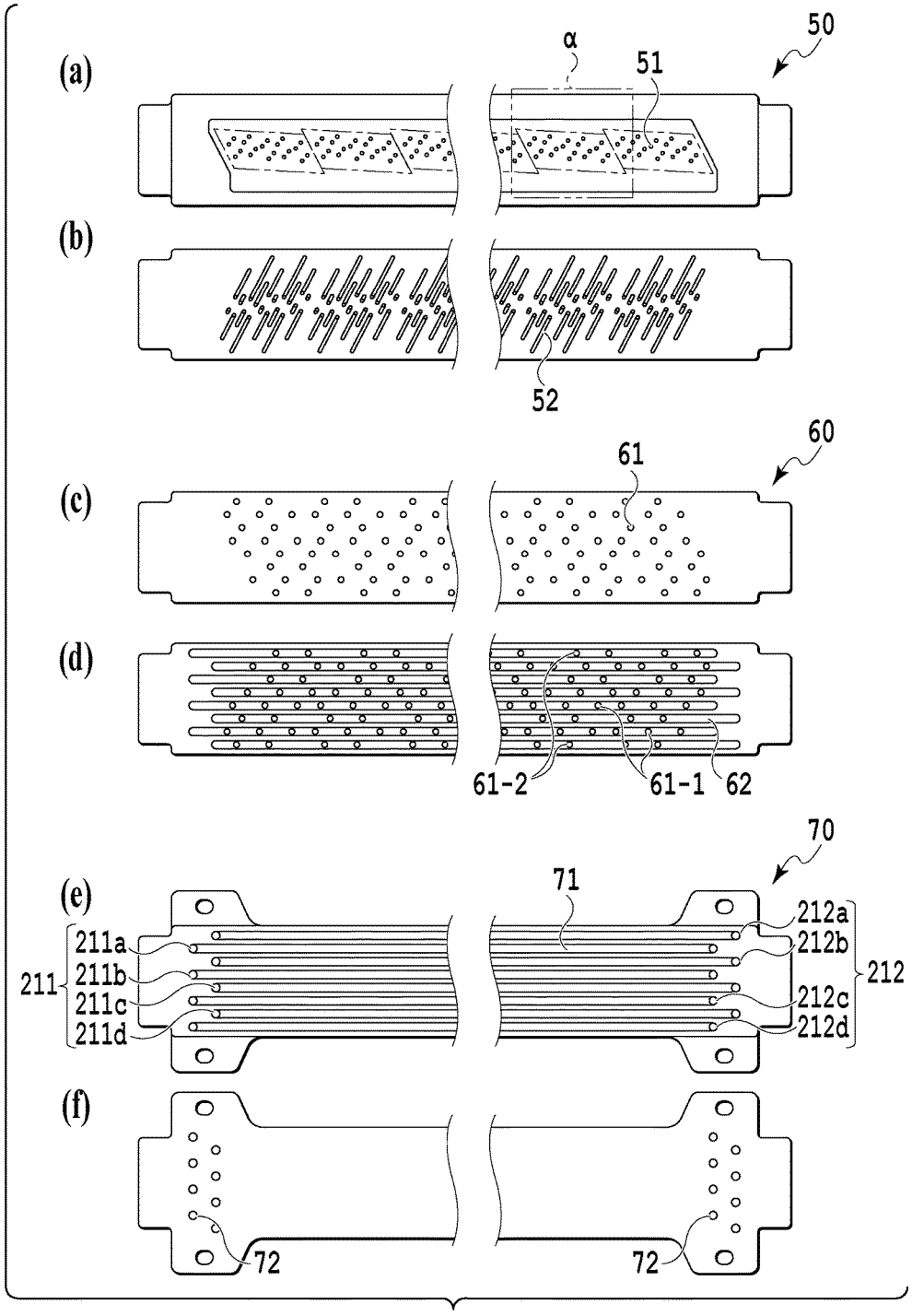
FIG. 7 is a diagram illustrating front and rear faces of first to third passage members.

Parts (a) to (f) of FIG. 7 are diagrams illustrating front and rear faces of the first to third passage members. Part (a) of FIG. 7 illustrates a face onto which the ejection module 200 is mounted in the first passage member 50 and part (f) of FIG. 7 illustrates a face with which the liquid ejection unit support portion 81 comes into contact in the third passage member 70. The first passage member 50 and the second passage member 60 are bonded to teach other so that the parts illustrated in parts (b) and (c) of FIG. 7 and corresponding to the contact faces of the passage members face each other and the second passage member and the third passage member are bonded to each other so that the parts illustrated in parts (d) and (e) of FIG. 7 and corresponding to the contact faces of the passage members face each other. When the second passage member 60 and the third passage member 70 are bonded to each other, eight common passages (211*a*, 211*b*, 211*c*, 211*d*, 212*a*, 212*b*, 212*c*, 212*d*) extending in the longitudinal direction of the passage member are formed by common passage grooves 62 and 71 of the passage members.

Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see part (f) of FIG. 7) of the third passage member 70 communicates with the holes of the joint rubber 100 and is fluid-connected to the liquid supply unit 220 (see FIG. 6). A bottom face of the common passage groove 62 of the second passage member 60 is provided with a plurality of communication openings (a communication opening 61-1 communicating with the common supply passage 211 and a communication opening 61-2 communicating with the common collection passage 212) and communicates with one end of an individual passage groove 52 of the first passage member 50. The other end of the individual passage groove 52 of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), PSF (polysulfone), or modified PPE (polyphenylene ether) can be appropriately used. As a method of forming the passage member 210, three passage members may be laminated and adhered to one another. When a resin composite material is selected as a material, a bonding method using welding may be used.

Figure 8:
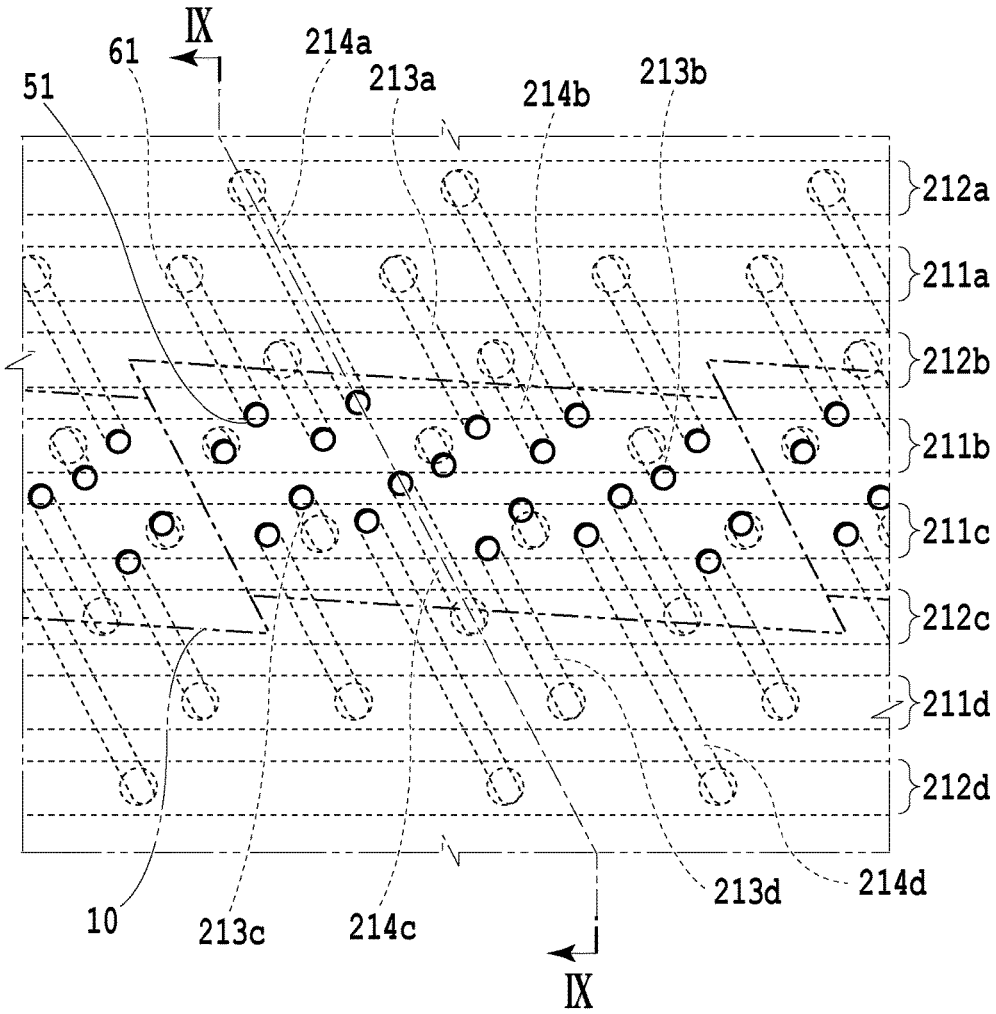
FIG. 8 is a perspective view illustrating a part $\alpha$ of FIG. 7(*a*) when viewed from an ejection module mounting face.

FIG. 8 is a partially enlarged perspective view illustrating a part α of part (a) Of FIG. 7 and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 of different colors through the communication openings 61. Further, the individual collection passages 214 (214*a*, 214*b*, 214*c*, 214*d*) formed by the individual passage grooves 52 are connected to the common collection passages 212 of different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 9:
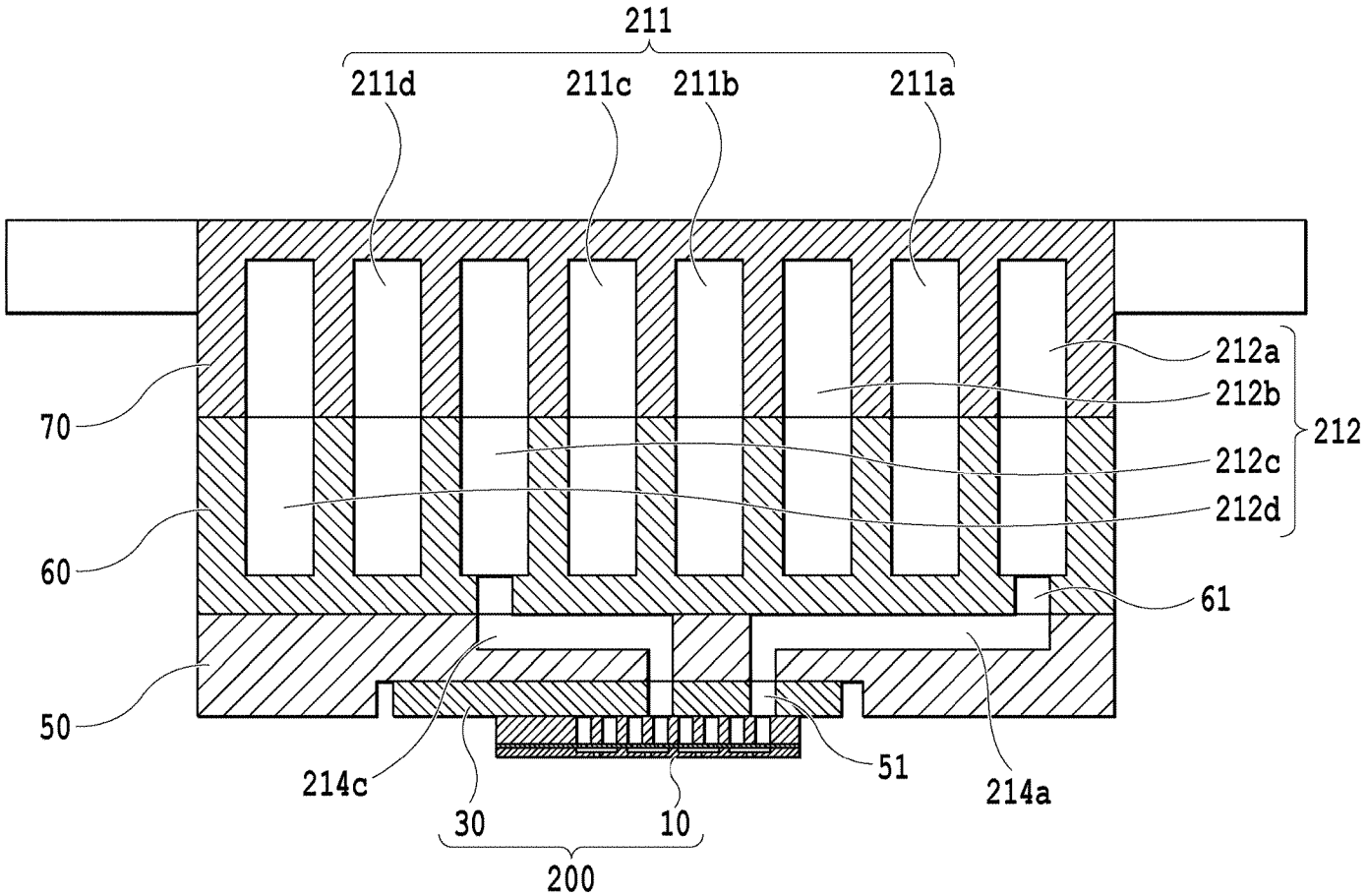
FIG. 9 is a cross-sectional view taken along a line IX-IX of FIG. 8.

FIG. 9 is a cross-sectional view taken along a line IX-IX of FIG. 8. The individual collection passage (214*a*, 214*c*) communicates with the ejection module 200 through the communication opening 51. In FIG. 9, only the individual collection passage (214*a*, 214*c*) is illustrated, but in a different cross-section, the individual supply passage 213 and the ejection module 200 communicates with each other as illustrated in FIG. 8. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the negative pressure control unit 230 (the high pressure side) of corresponding color through the liquid supply unit 220 and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 8 and 9, a flow is generated in order of the common supply passage 211 of each color, the individual supply passage 213, the print element board 10, the individual collection passage 214, and the common collection passage 212 inside the liquid ejection head of the application example having the passages connected to one another.

(Description of Ejection Module)

Figure 10A:
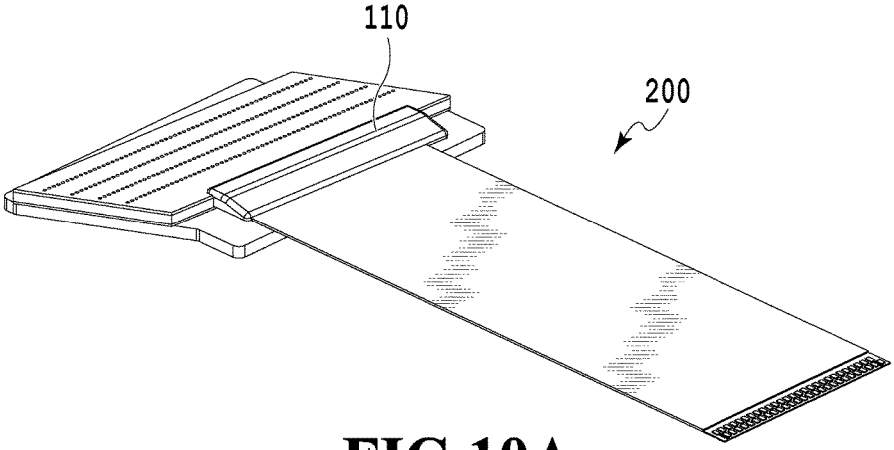
FIG. 10A is a perspective view illustrating one ejection module.
Figure 10B:
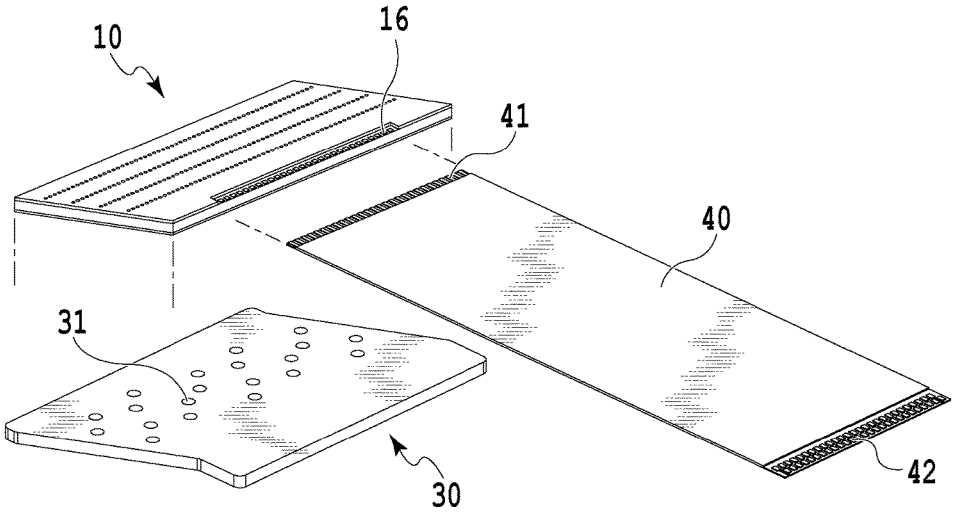
FIG. 10B is an exploded view illustrating one ejection module.

FIG. 10A is a perspective view illustrating one ejection module 200 and FIG. 10B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110.

A terminal 42 which is opposite to the print element board 10 of the flexible circuit board 40 is electrically connected to a connection terminal 93 (see FIG. 6) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 11A:
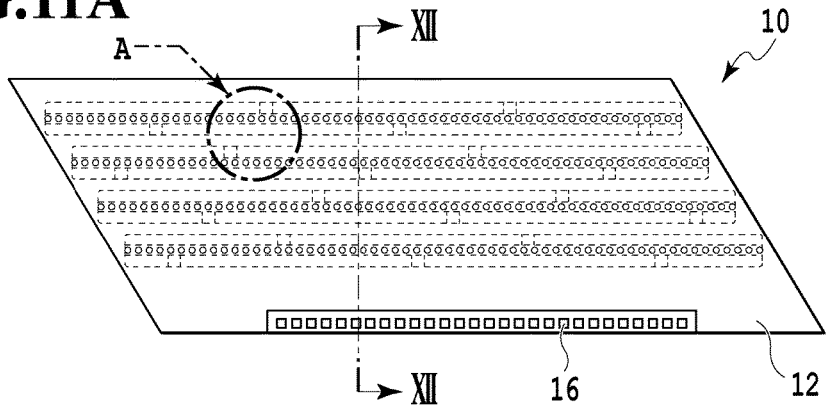
FIG. 11A is a diagram illustrating a print element board.
Figure 11B:
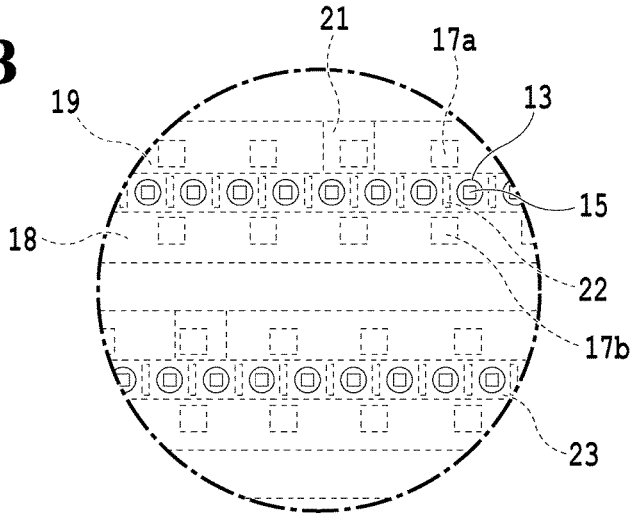
FIG. 11B is a diagram illustrating the print element board.
Figure 11C:
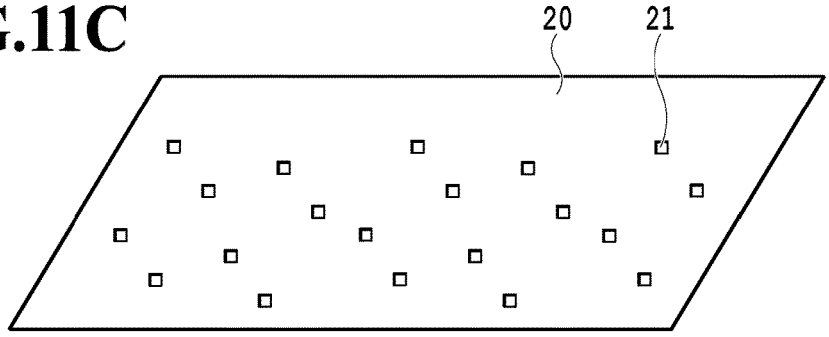
FIG. 11C is a diagram illustrating the print element board.

FIG. 11A is a top view illustrating a face provided with an ejection opening 13 in the print element board 10, FIG. 11B is an enlarged view of a part A of FIG. 11A, and FIG. 11C is a top view illustrating a rear face of FIG. 11A. Here, a configuration of the print element board of the application example will be described. As illustrated in FIG. 11A, an ejection opening forming member of the print element board 10 is provided with four ejection opening rows corresponding to different colors of inks. Further, the extension direction of the ejection opening rows of the ejection openings 13 will be referred to as an "ejection opening row direction". As illustrated in FIG. 11B, the print element 15 serving as an ejection energy generation element for ejecting the liquid by heat energy is disposed at a position corresponding to each ejection opening 13. A pressure chamber 23 provided inside the print element 15 is defined by a partition wall 22.

The print element 15 is electrically connected to the terminal 16 by an electric wire (not illustrated) provided in the print element board 10. Then, the print element 15 boils the liquid while being heated on the basis of a pulse signal input from a control circuit of the printing apparatus 1000 via the electric wiring board 90 (see FIG. 6) and the flexible circuit board 40 (see FIG. 10B). The liquid is ejected from the ejection opening 13 by a foaming force caused by the boiling. As illustrated in FIG. 11B, a liquid supply path 18 extends at one side along each ejection opening row and a liquid collection path 19 extends at the other side along the ejection opening row. The liquid supply path 18 and the liquid collection path 19 are passages that extend in the ejection opening row direction provided in the print element board 10 and communicate with the ejection opening 13 through a supply opening 17*a* and a collection opening 17*b*.

As illustrated in FIG. 11C, a sheet-shaped lid member 20 is laminated on a rear face of a face provided with the ejection opening 13 in the print element board 10 and the lid member 20 is provided with a plurality of openings 21 communicating with the liquid supply path 18 and the liquid collection path 19. In the application example, the lid member 20 is provided with three openings 21 for each liquid supply path 18 and two openings 21 for each liquid collection path 19. As illustrated in FIG. 11B, openings 21 of the lid member 20 communicate with the communication openings 51 illustrated in part (a) of FIG. 7.

It is desirable that the lid member 20 have sufficient corrosion resistance for the liquid. From the viewpoint of preventing mixed color, the opening shape and the opening position of the opening 21 need to have high accuracy. For this reason, it is desirable to form the opening 21 by using a photosensitive resin material or a silicon plate as a material of the lid member 20 through photolithography. In this way, the lid member 20 changes the pitch of the passages by the opening 21. Here, it is desirable to form the lid member 20 by a film-shaped member with a thin thickness in consideration of pressure loss.

Figure 12:
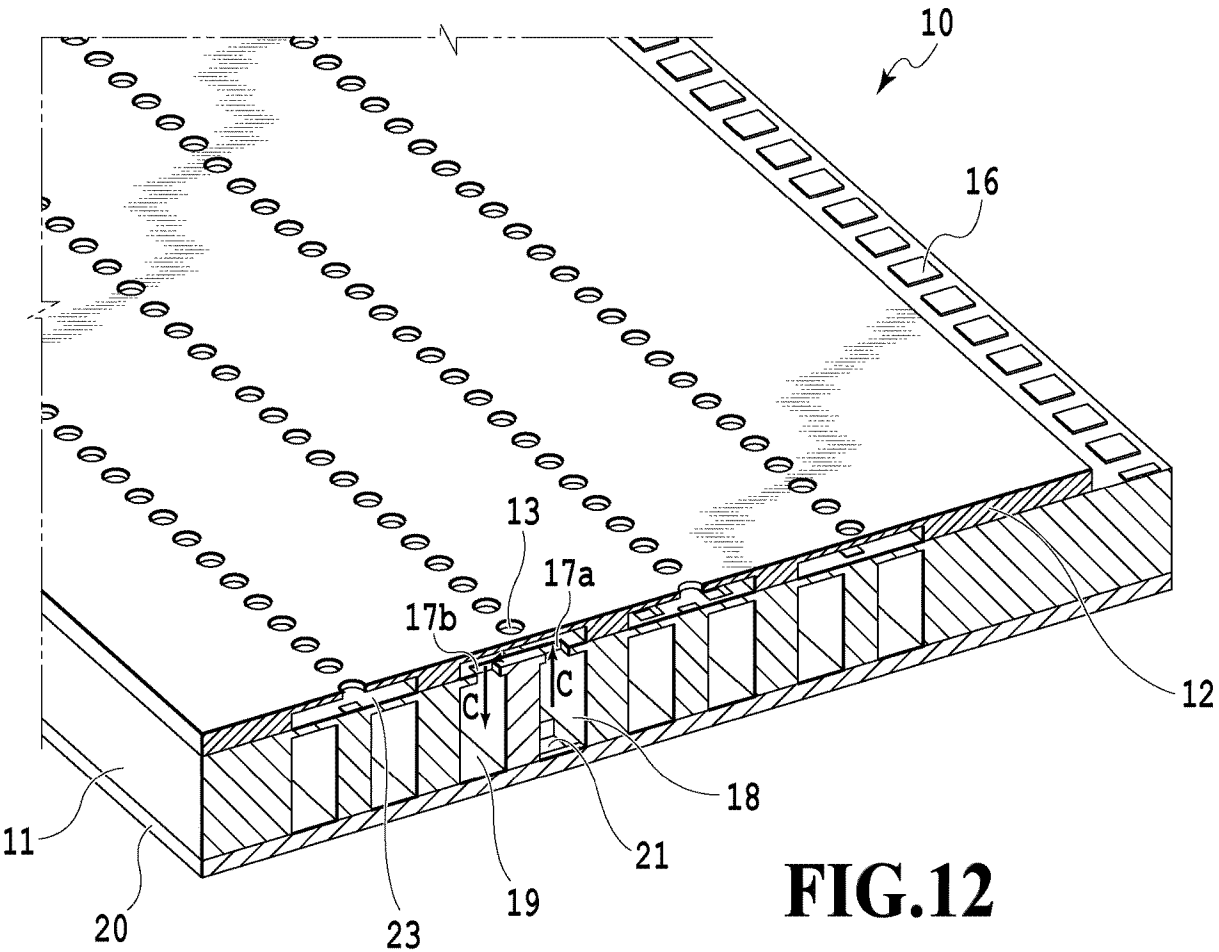
FIG. 12 is a perspective view illustrating cross-sections of the print element board and a lid member.

FIG. 12 is a perspective view illustrating cross-sections of the print element board 10 and the lid member 20 when taken along a line XII-XII of FIG. 11A. Here, a flow of the liquid inside the print element board 10 will be described. The lid member 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the lid member 20 is bonded to a rear face of the substrate 11. One face of the substrate 11 is provided with the print element 15 (see FIG. 11B) and a rear face thereof is provided with grooves forming the liquid supply path 18 and the liquid collection path 19 extending along the ejection opening row.

The liquid supply path 18 and the liquid collection path 19 which are formed by the substrate 11 and the lid member 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 12). By the flow, foreign materials, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed.

The liquid which is collected to the liquid collection path 19 is collected in order of the communication opening 51 (see part (a) of FIG. 7) inside the passage member 210, the individual collection passage 214, and the common collection passage 212 through the opening 21 of the lid member 20 and the liquid communication opening 31 (see FIG. 10B) of the support member 30. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the lid member 20, and the liquid supply path 18 and the supply opening 17*a* provided in the substrate 11.

In the liquid supplied to the pressure chamber 23, the liquid which is not ejected from the ejection opening 13 sequentially flows through the collection opening 17*b* and the liquid collection path 19 provided in the substrate 11, the opening 21 provided in the lid member 20, and the liquid communication opening 31 provided in the support member 30. Subsequently, the liquid sequentially flows through the communication opening 51 and the individual passage groove 52 provided in the first passage member, the communication opening 61 and the common passage groove 62 provided in the second passage member, the common passage groove 71 and the communication opening 72 provided in the third passage member 70, and the joint rubber 100. Then, the liquid flows from the liquid connection portion 111 provided in the liquid supply unit 220 to the outside of the liquid ejection head 3.

In the first circulation mode illustrated in FIG. 2, the liquid which flows from the liquid connection portion 111 is supplied to the joint rubber 100 through the negative pressure control unit 230. Further, in the second circulation mode illustrated in FIG. 3, the liquid which is collected from the pressure chamber 23 passes through the joint rubber 100 and flows from the liquid connection portion 111 to the outside of the liquid ejection head through the negative pressure control unit 230. The entire liquid which flows from one end of the common supply passage 211 of the liquid ejection unit 300 is not supplied to the pressure chamber 23 through the individual supply passage 213*a*.

That is, the liquid may flow from the other end of the common supply passage 211 to the liquid supply unit 220 while not flowing into the individual supply passage 213*a* by the liquid which flows from one end of the common supply passage 211. In this way, since the path is provided so that the liquid flows therethrough without passing through the print element board 10, the reverse flow of the circulation flow of the liquid can be suppressed even in the print element board 10 including the large passage with a small flow resistance as in the application example. In this way, since the thickening of the liquid in the vicinity of the ejection opening or the pressure chamber 23 can be suppressed in the liquid ejection head 3 of the application example, a slippage or a non-ejection can be suppressed. As a result, a high-quality image can be printed.

(Description of Positional Relation Among Print Element Boards)

Figure 13:
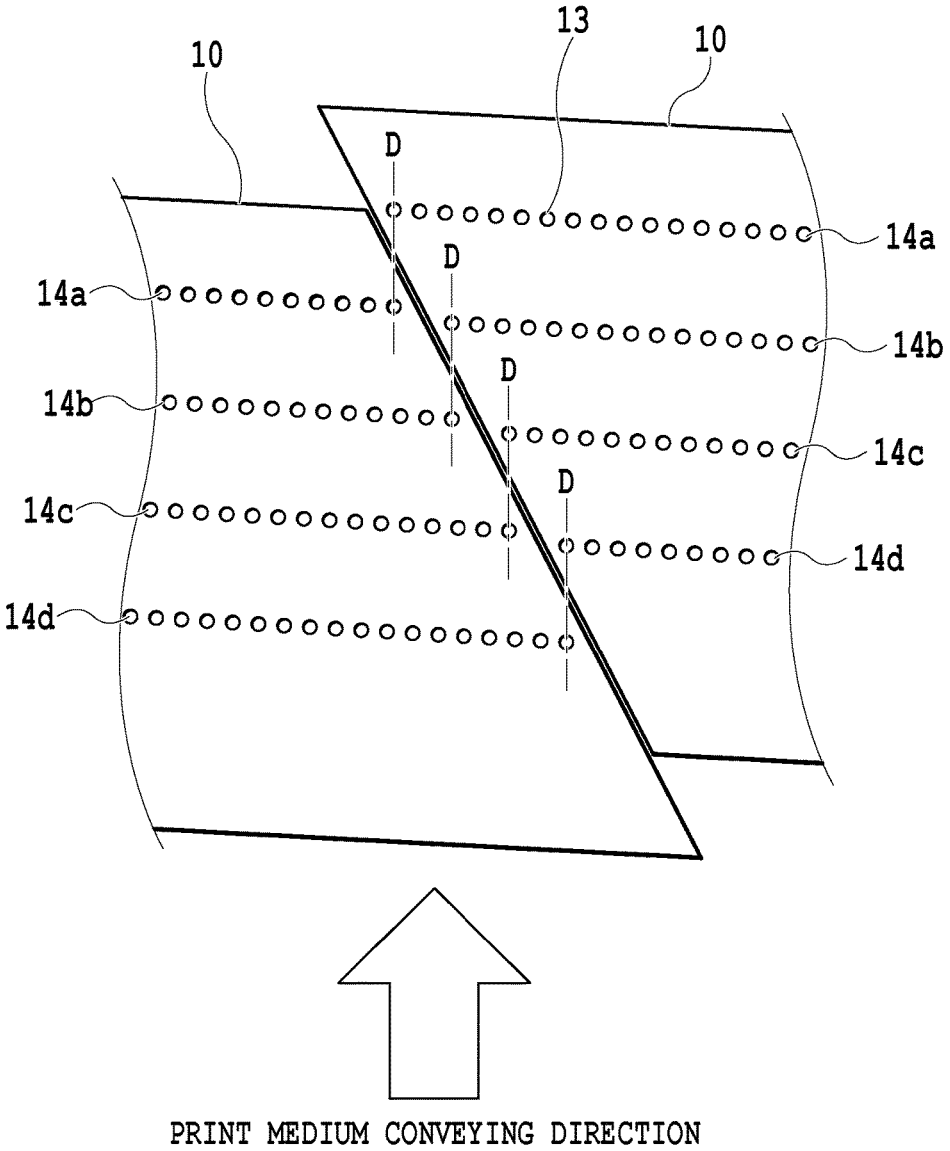
FIG. 13 is a partially enlarged top view of an adjacent portion of the print element board.

FIG. 13 is a partially enlarged top view illustrating an adjacent portion of the print element board in two adjacent ejection modules. In the application example, a substantially parallelogram print element board is used. Ejection opening rows (14*a* to 14*d*) having the ejection openings 13 arranged in each print element board 10 are disposed to be inclined while having a predetermined angle with respect to the longitudinal direction of the liquid ejection head 3. Then, the ejection opening row at the adjacent portion between the print element boards 10 is formed such that at least one ejection opening overlaps in the print medium conveying direction. In FIG. 13, two ejection openings on a line D overlap each other.

With such an arrangement, even when a position of the print element board 10 is slightly deviated from a predetermined position, black streaks or missing of a print image cannot be seen by a driving control of the overlapping ejection openings. Even when the print element boards 10 are disposed in a straight linear shape (an in-line shape) instead of a zigzag shape, black streaks or missing at the connection portion between the print element boards 10 can be handled while an increase in the length of the liquid ejection head 3 in the print medium conveying direction is suppressed by the configuration illustrated in FIG. 13. Further, in the application example, a principal plane of the print element board has a parallelogram shape, but the invention is not limited thereto. For example, even when the print element boards having a rectangular shape, a trapezoid shape, and the other shapes are used, the configuration of the invention can be desirably used.

(Description of Modified Example of Configuration of Liquid Ejection Head)

Figure 28:
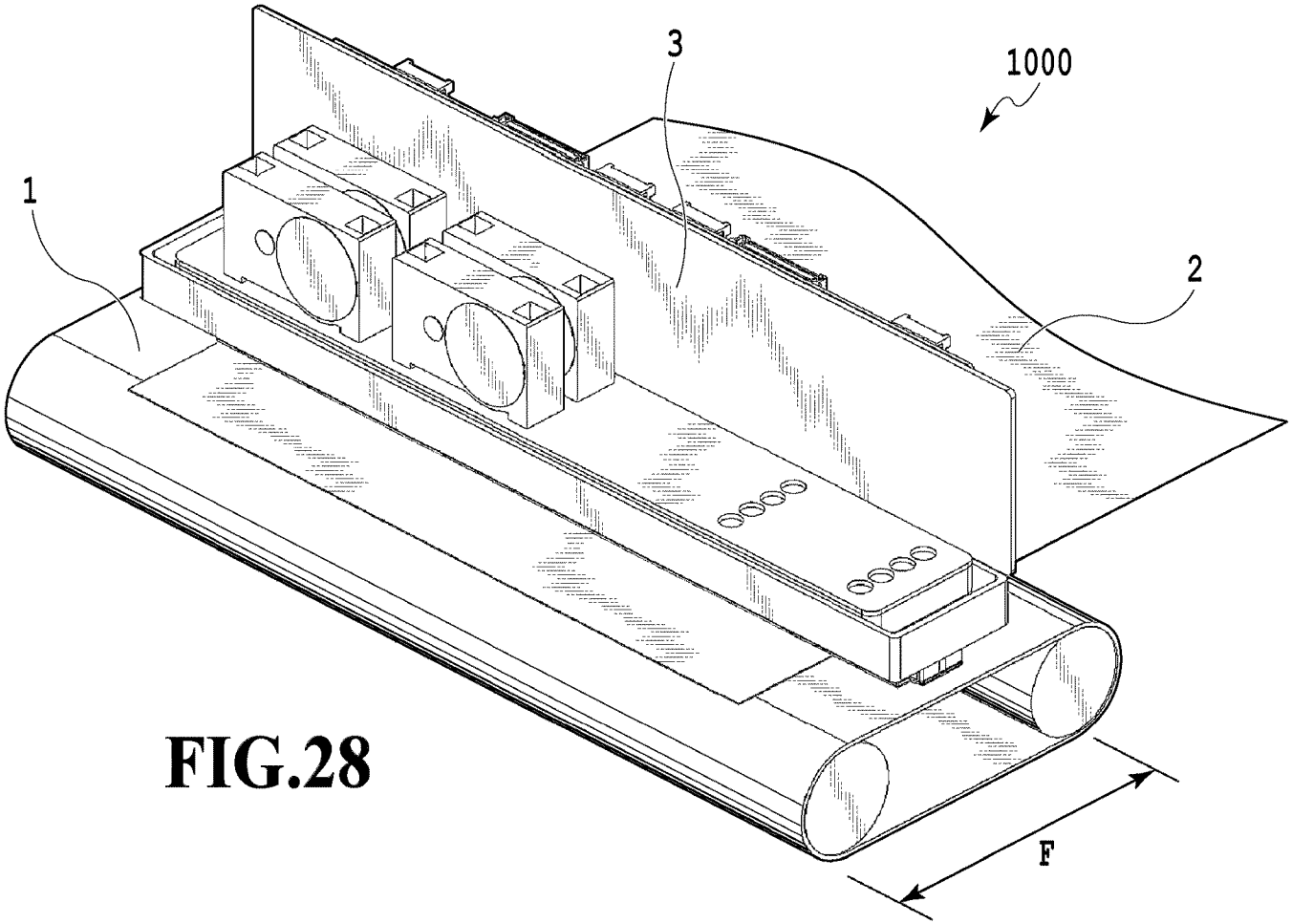
FIG. 28 is a diagram illustrating a printing apparatus according to a first application example.
Figure 30A:
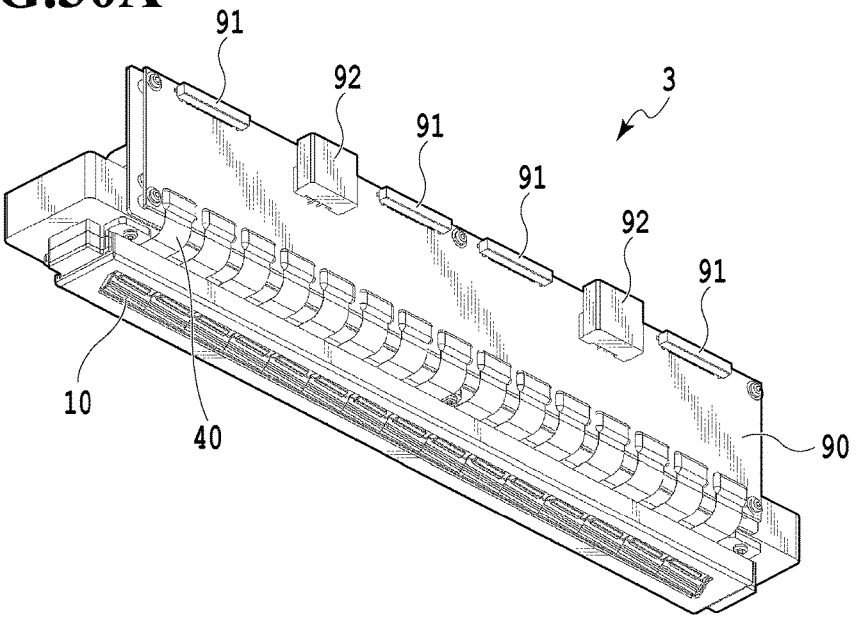
FIG. 30A is a diagram illustrating a modified example of a liquid ejection head according to the first application example.
Figure 30B:
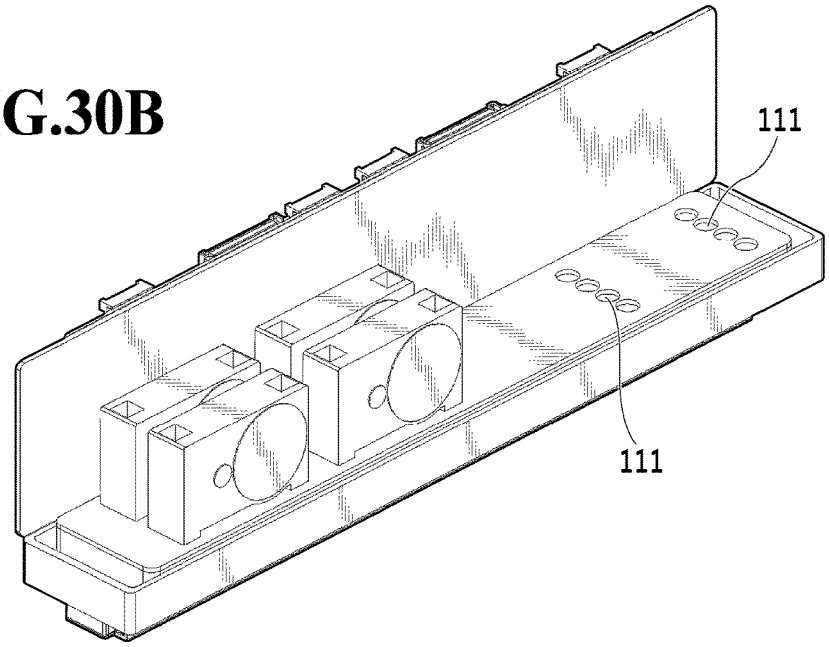
FIG. 30B is a diagram illustrating a modified example of a liquid ejection head according to the first application example.
Figure 31:
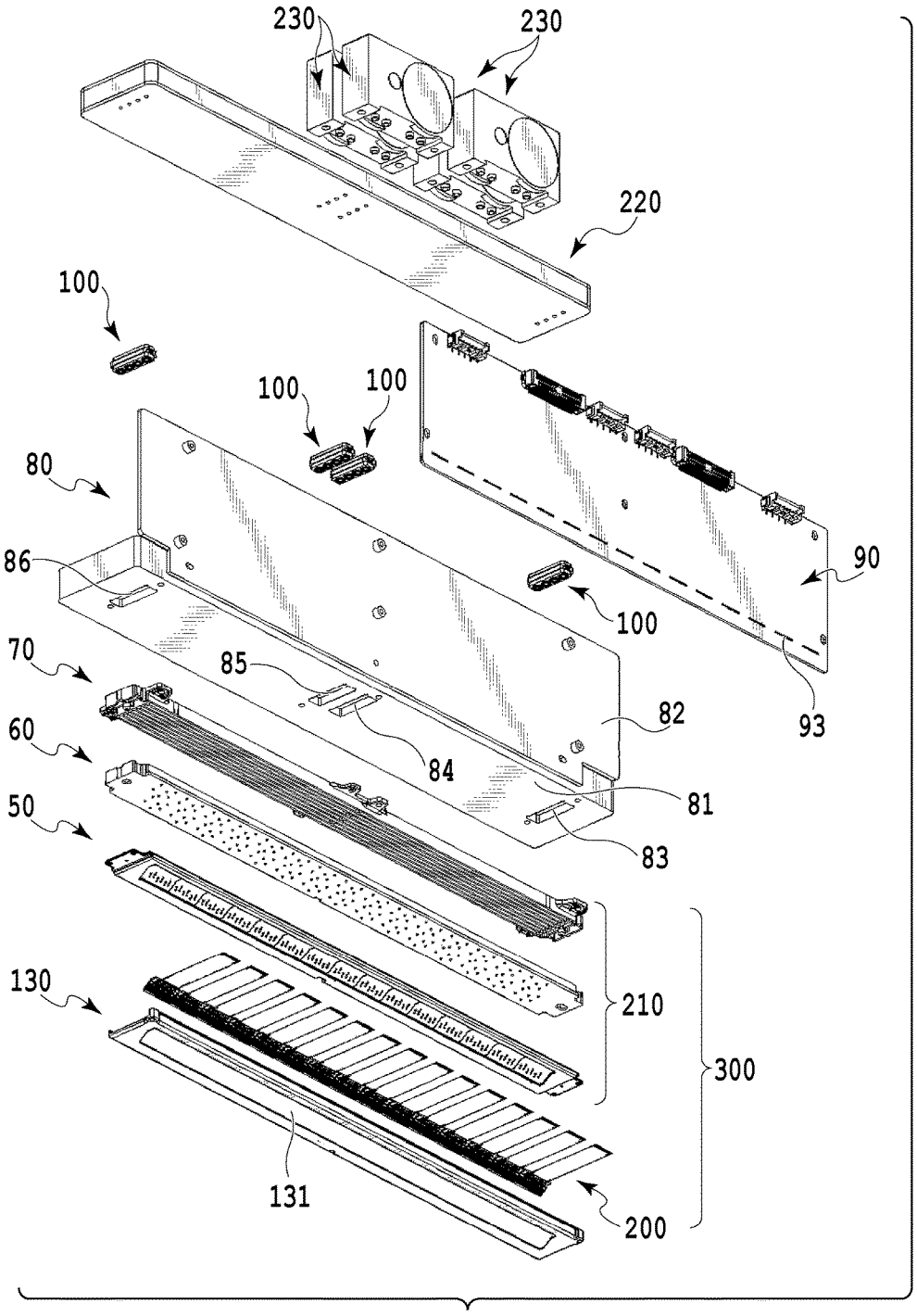
FIG. 31 is a diagram illustrating a modified example of the liquid ejection head according to the first application example.

A modified example of a configuration of the liquid ejection head illustrated in FIG. 28 and FIGS. 30A to 32 will be described. A description of the same configuration and function as those of the above-described example will be omitted and only a difference will be mainly described. In the modified example, as illustrated in FIGS. 28, 30A, and 30B, the liquid connection portions 111 between the liquid ejection head 3 and the outside are intensively disposed at one end side of the liquid ejection head in the longitudinal direction. The negative pressure control units 230 are intensively disposed at the other end side of the liquid ejection head 3 (see FIG. 31). The liquid supply unit 220 that belongs to the liquid ejection head 3 is configured as an elongated unit corresponding to the length of the liquid ejection head 3 and includes passages and filters 221 respectively corresponding to four liquids to be supplied. As illustrated in FIG. 31, the positions of the openings 83 to 86 provided at the liquid ejection unit support portion 81 are also located at positions different from those of the liquid ejection head 3.

Figure 32:
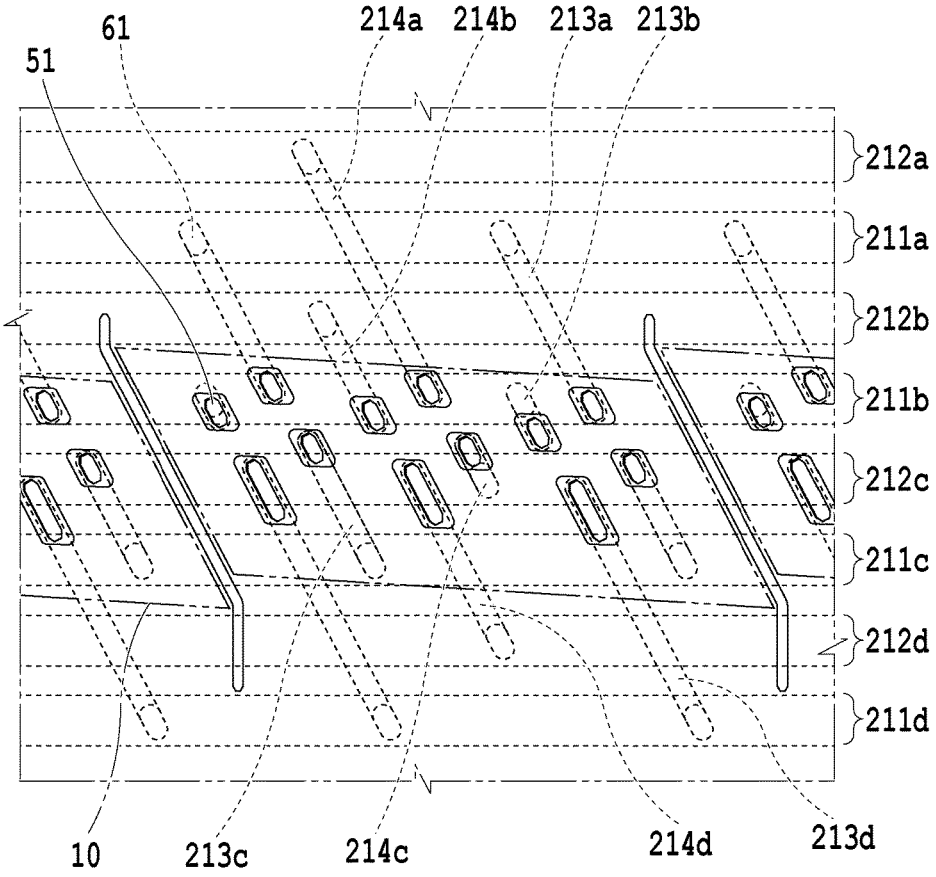
FIG. 32 is a diagram illustrating a modified example of the liquid ejection head according to the first application example.

FIG. 32 illustrates a lamination state of the passage members 50, 60, and 70. The print element boards 10 are arranged linearly on the upper face of the passage member 50 which is the uppermost layer among the passage members 50, 60, and 70. As the passage which communicates with the opening 21 (see FIGS. 19A and 19B) formed at the rear face side of each print element board 10, two individual supply passages 213 and one individual collection passage 214 are provided for each color of the liquid. Accordingly, as the opening 21 which is formed at the lid member 20 provided at the rear face of the print element board 10, two supply openings 21 and one collection opening 21 are provided for each color of the liquid. As illustrated in FIG. 32, the common supply passage 211 and the common collection passage 212 extending along the longitudinal direction of the liquid ejection head 3 are alternately arranged.

Second Application Example

Hereinafter, configurations of an inkjet printing apparatus 2000 and a liquid ejection head 2003 according to a second application example of the invention will be described with reference to the drawings. In the description below, only a difference from the first application example will be described and a description of the same components as those of the first application example will be omitted.

(Description of Inkjet Printing Apparatus)

Figure 21:
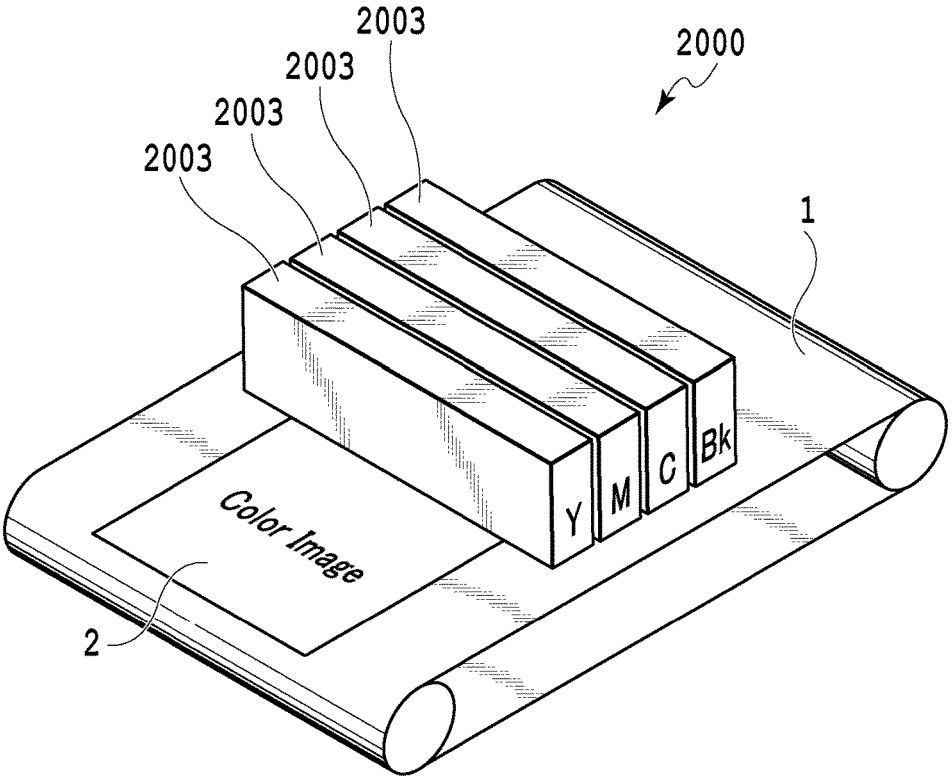
FIG. 21 is a diagram illustrating an inkjet printing apparatus that prints an image by ejecting a liquid.

FIG. 21 is a diagram illustrating the inkjet printing apparatus 2000 according to the application example used to eject the liquid. The printing apparatus 2000 of the application example is different from the first application example in that a full color image is printed on the print medium by a configuration in which four monochromic liquid ejection heads 2003 respectively corresponding to the inks of cyan C, magenta M, yellow Y, and black K are disposed in parallel. In the first application example, the number of the ejection opening rows which can be used for one color is one. However, in the application example, the number of the ejection opening rows which can be used for one color is twenty. For this reason, when print data is appropriately distributed to a plurality of ejection opening rows to print an image, an image can be printed at a higher speed.

Further, even when there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to the first application example, the supply system, the buffer tank 1003 (see FIGS. 2 and 3), and the main tank 1006 (see FIGS. 2 and 3) of the printing apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the first application example, the first and second circulation modes illustrated in FIG. 2 or 3 can be used as the liquid circulation mode between the printing apparatus 2000 and the liquid ejection head 2003.

(Description of Structure of Liquid Ejection Head)

Figure 14A:
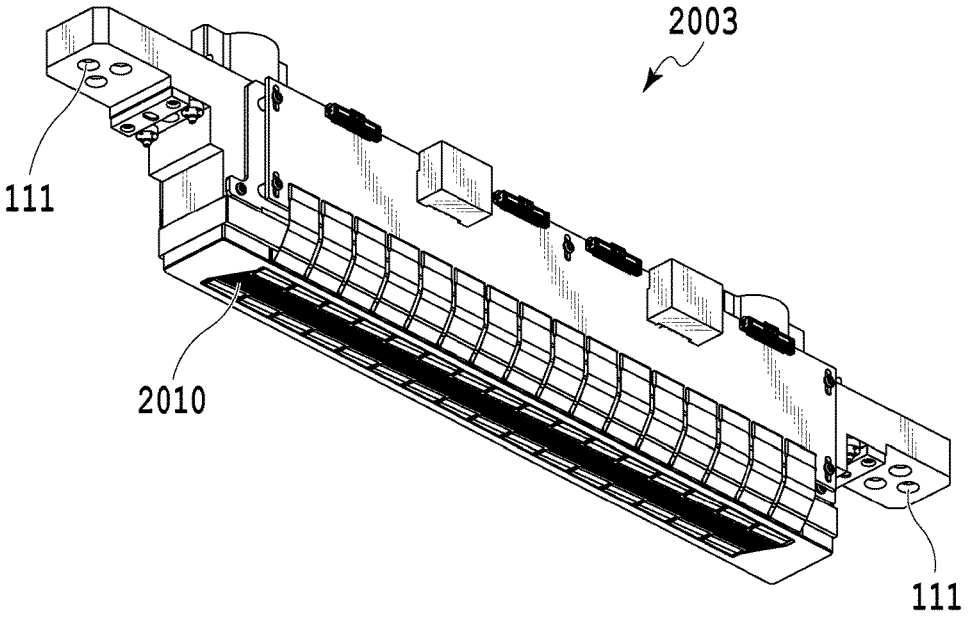
FIG. 14A is a perspective view illustrating the liquid ejection head.
Figure 14B:
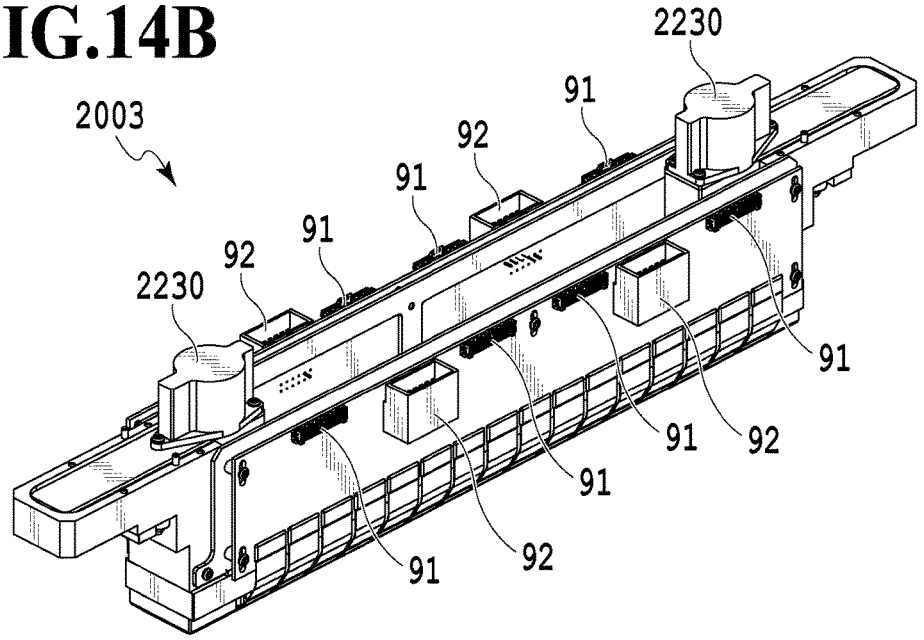
FIG. 14B is a perspective view illustrating the liquid ejection head.

FIGS. 14A and 14B are perspective views illustrating the liquid ejection head 2003 according to the application example. Here, a structure of the liquid ejection head 2003 according to the application example will be described. The liquid ejection head 2003 is an inkjet line type (page wide type) print head which includes sixteen print element boards 2010 arranged linearly in the longitudinal direction of the liquid ejection head 2003 and can print an image by one kind of liquid. Similarly to the first application example, the liquid ejection head 2003 includes the liquid connection portion 111, the signal input terminal 91, and the power supply terminal 92. However, since the liquid ejection head 2003 of the application example includes many ejection opening rows compared with the first application example, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 15:
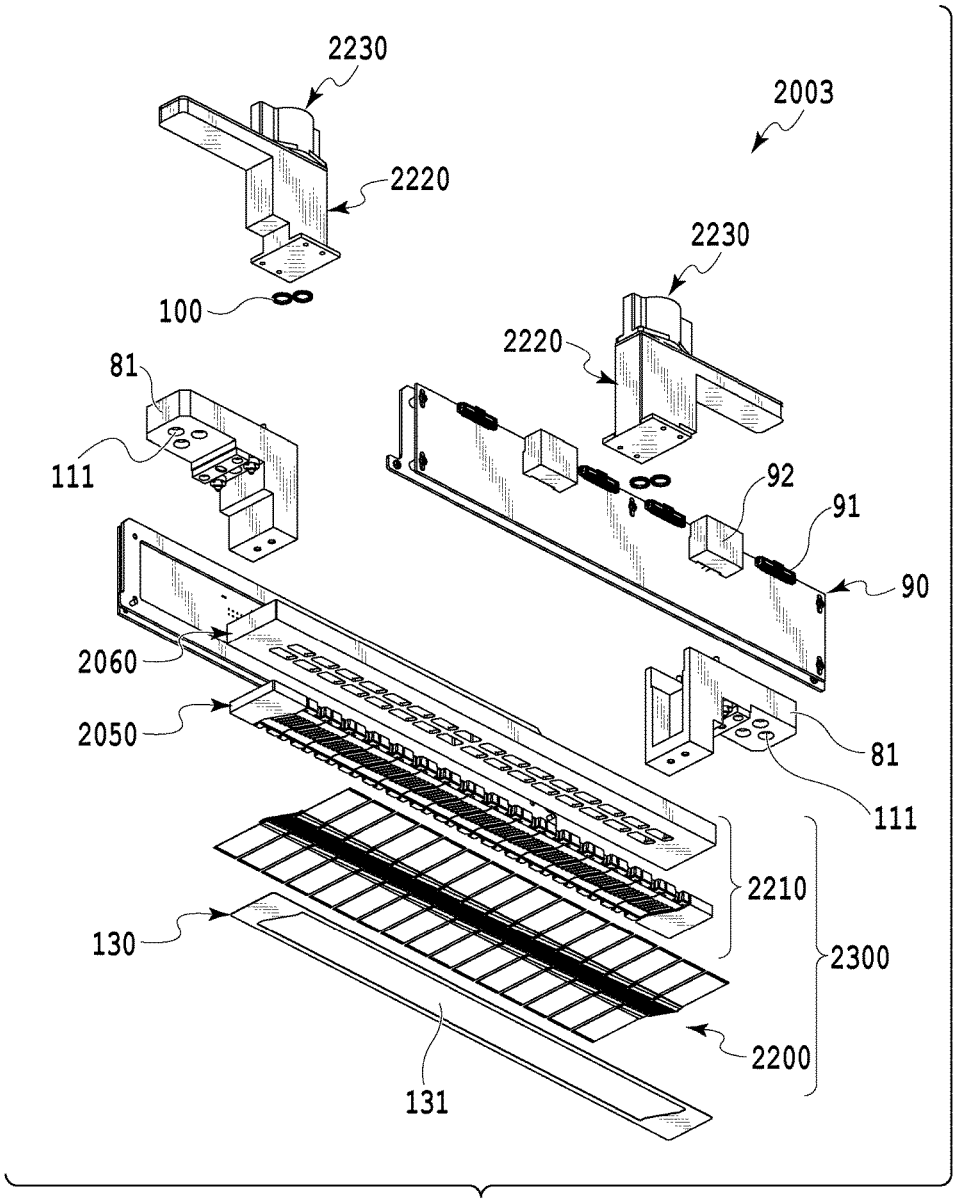
FIG. 15 is an oblique exploded view illustrating the liquid ejection head.

FIG. 15 is an oblique exploded view illustrating the liquid ejection head 2003 and components or units constituting the liquid ejection head 2003 according to the functions thereof. The function of each of units and members or the liquid flow sequence inside the liquid ejection head is basically similar to that of the first application example, but the function of guaranteeing the rigidity of the liquid ejection head is different. In the first application example, the rigidity of the liquid ejection head is mainly guaranteed by the liquid ejection unit support portion 81, but in the liquid ejection head 2003 of the second application example, the rigidity of the liquid ejection head is guaranteed by a second passage member 2060 included in a liquid ejection unit 2300.

The liquid ejection unit support portion 81 of the application example is connected to both ends of the second passage member 2060 and the liquid ejection unit 2300 is mechanically connected to a carriage of the printing apparatus 2000 to position the liquid ejection head 2003. The electric wiring board 90 and a liquid supply unit 2220 including a negative pressure control unit 2230 are connected to the liquid ejection unit support portion 81. Each of two liquid supply units 2220 includes a filter (not illustrated) built therein.

Two negative pressure control units 2230 are set to control a pressure at different and relatively high and low negative pressures. Further, as in FIGS. 14B and 15, when the negative pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 15, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 16:
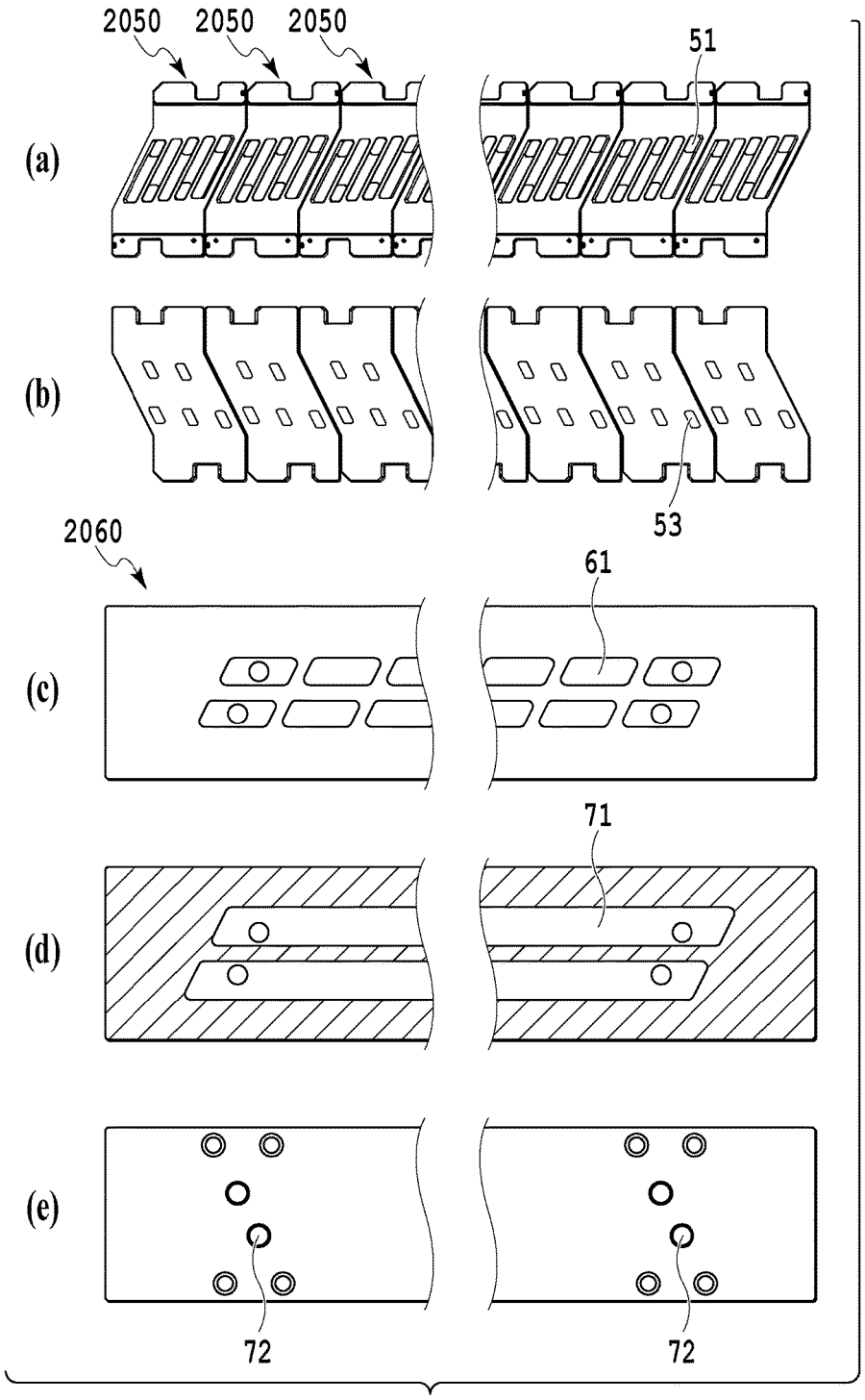
FIG. 16 is a diagram illustrating the first passage member.

Part (a) of FIG. 16 is a diagram illustrating a face onto which the ejection module 2200 is mounted in the first passage member 2050 and part (b) of FIG. 16 is a diagram illustrating a rear face thereof and a face contacting the second passage member 2060. Differently from the first application example, the first passage member 2050 of the application example has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more.

As illustrated in part (a) of FIG. 16, the communication opening 51 of the first passage member 2050 fluid-communicates with the ejection module 2200. As illustrated in part (b) of FIG. 16, the individual communication opening 53 of the first passage member 2050 fluid-communicates with the communication opening 61 of the second passage member 2060. Part (c) of FIG. 16 illustrates a contact face of the second passage member 60 with respect to the first passage member 2050, part (d) of FIG. 16 illustrates a cross-section of a center portion of the second passage member 60 in the thickness direction, and part (e) of FIG. 16 is a diagram illustrating a contact face of the second passage member 2060 with respect to the liquid supply unit 2220. The function of the communication opening or the passage of the second passage member 2060 is similar to each color of the first application example. The common passage groove 71 of the second passage member 2060 is formed such that one side thereof is a common supply passage 2211 illustrated in FIG. 17 and the other side thereof is a common collection passage 2212. These passages are respectively provided along the longitudinal direction of the liquid ejection head 2003 so that the liquid is supplied from one end thereof to the other end thereof. The application example is different from the first application example in that the liquid flow directions in the common supply passage 2211 and the common collection passage 2212 are opposite to each other.

Figure 17:
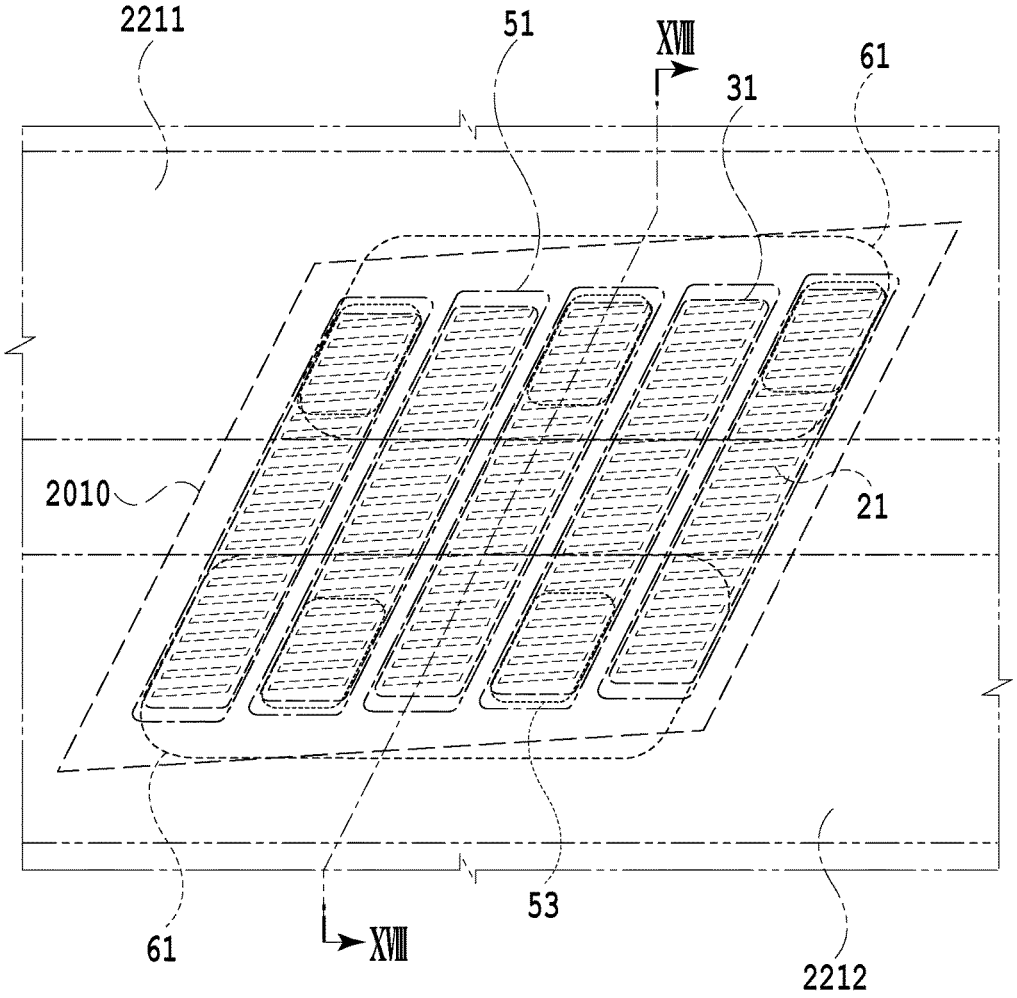
FIG. 17 is a perspective view illustrating a liquid connection relation between the print element board and the passage member.

FIG. 17 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 18:
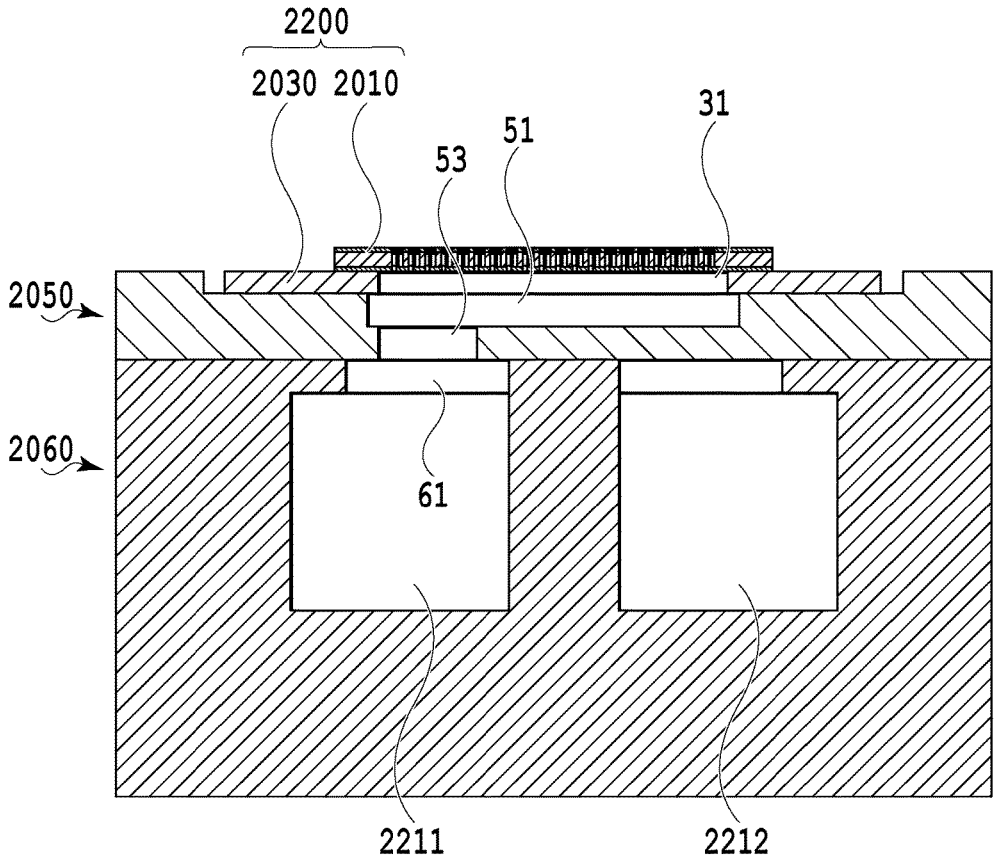
FIG. 18 is a cross-sectional view taken along a line XVIII-XVIII of FIG. 17.

FIG. 18 is a cross-sectional view taken along a line XVIII-XVIII of FIG. 17. The common supply passage 2211 is connected to the ejection module 2200 through the communication opening 61, the individual communication opening 53, and the communication opening 51. Although not illustrated in FIG. 18, it is obvious that the common collection passage 2212 is connected to the ejection module 2200 by the same path in a different cross-section in FIG. 17. Similarly to the first application example, each of the ejection module 2200 and the print element board 2010 is provided with a passage communicating with each ejection opening and thus a part or the entirety of the supplied liquid can be re-circulated while passing through the ejection opening that does not perform the ejection operation. Further, similarly to the first application example, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

Figure 19A:
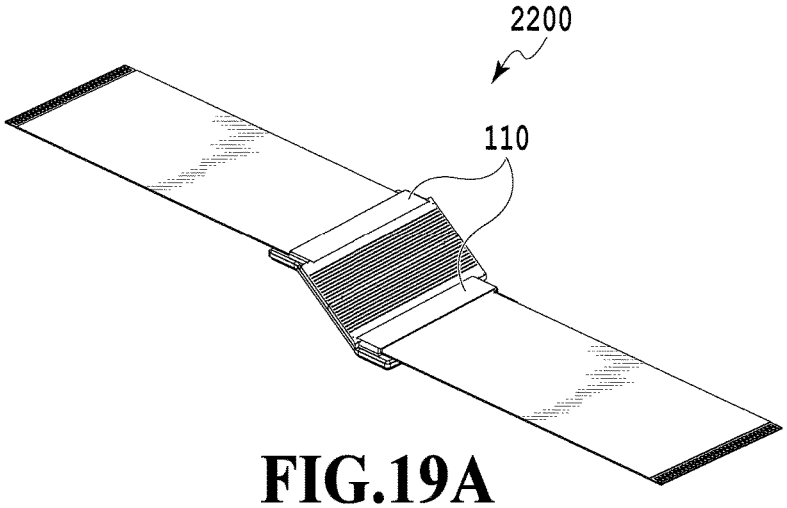
FIG. 19A is a perspective view illustrating one ejection module.
Figure 19B:
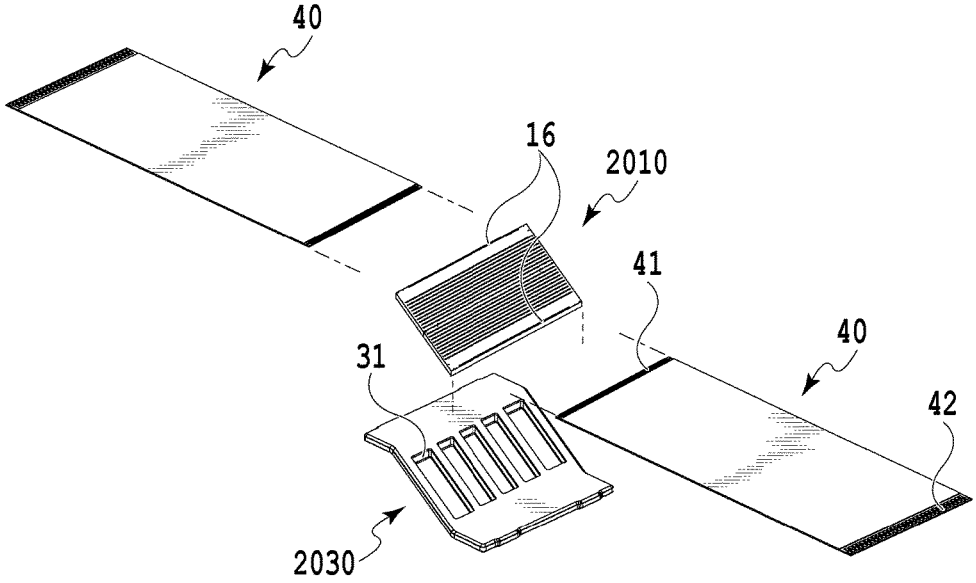
FIG. 19B is an exploded view illustrating one ejection module.

FIG. 19A is a perspective view illustrating one ejection module 2200 and FIG. 19B is an exploded view thereof. A difference from the first application example is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the first application example. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the first application example.

(Description of Structure of Print Element Board)

Figure 20:
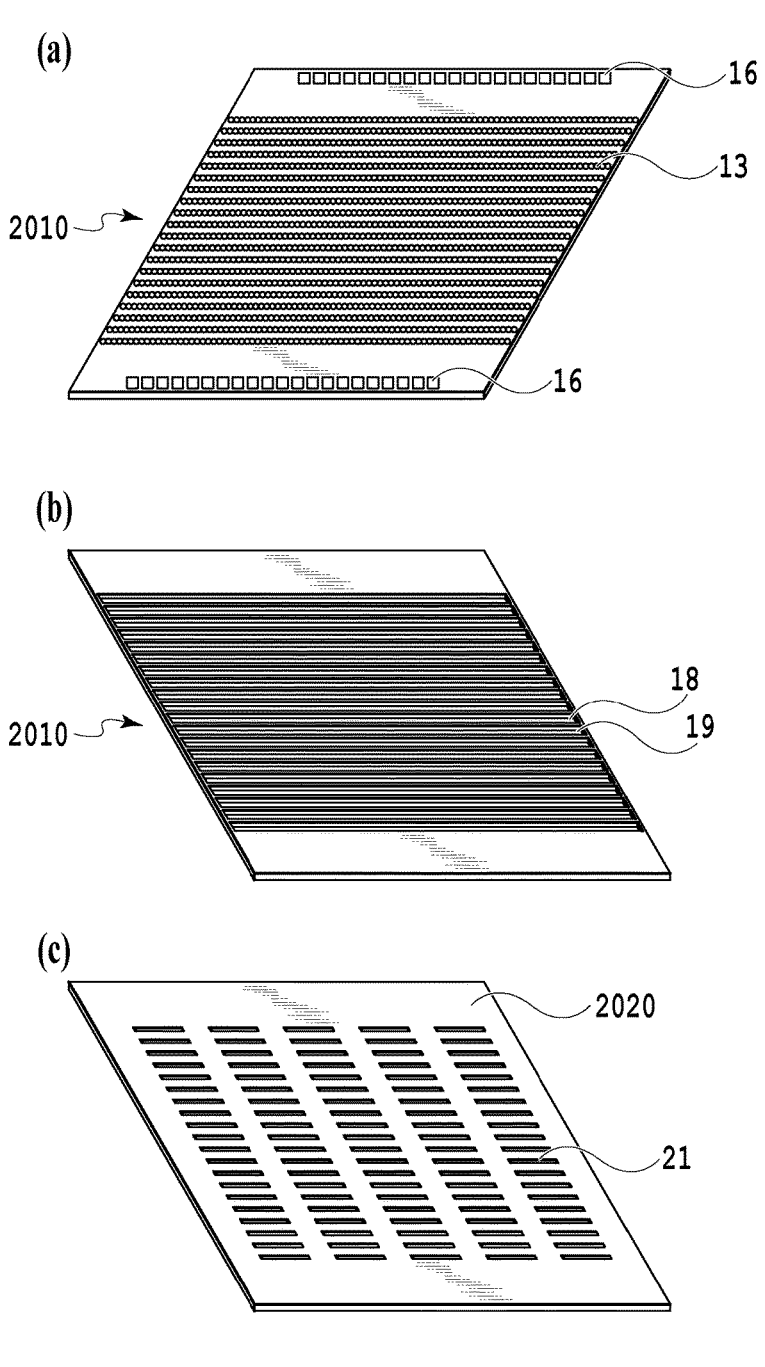
FIG. 20 is a schematic diagram illustrating the print element board.

Part (a) of FIG. 20 is a schematic diagram illustrating a face on which the ejection opening 13 is disposed in the print element board 2010 and part (c) of FIG. 20 is a schematic diagram illustrating a rear face of the face of part (a) of FIG. 20. Part (b) of FIG. 20 is a schematic diagram illustrating a face of the print element board 2010 when a lid member 2020 provided in the rear face of the print element board 2010 in part (c) of FIG. 20 is removed. As illustrated in part (b) of FIG. 20, the liquid supply path 18 and the liquid collection path 19 are alternately provided along the ejection opening row direction at the rear face of the print element board 2010.

The number of the ejection opening rows is larger than that of the first application example. However, a basic difference from the first application example is that the terminal 16 is disposed at both sides of the print element board in the ejection opening row direction as described above. A basic configuration is similar to the first application example in that a pair of the liquid supply path 18 and the liquid collection path 19 is provided in each ejection opening row and the lid member 2020 is provided with the opening 21 communicating with the liquid communication opening 31 of the support member 2030.

Third Application Example

Configurations of the inkjet printing apparatus 1000 and the liquid ejection head 3 according to a third application example of the invention will be described. The liquid ejection head of the third application example is of a page wide type in which an image is printed on a print medium of a B2 size through one scan. Since the third application example is similar to the second application example in many respects, only difference from the second application example will be mainly described in the description below and a description of the same configuration as that of the second application example will be omitted.

(Description of Inkjet Printing Apparatus)

Figure 33:
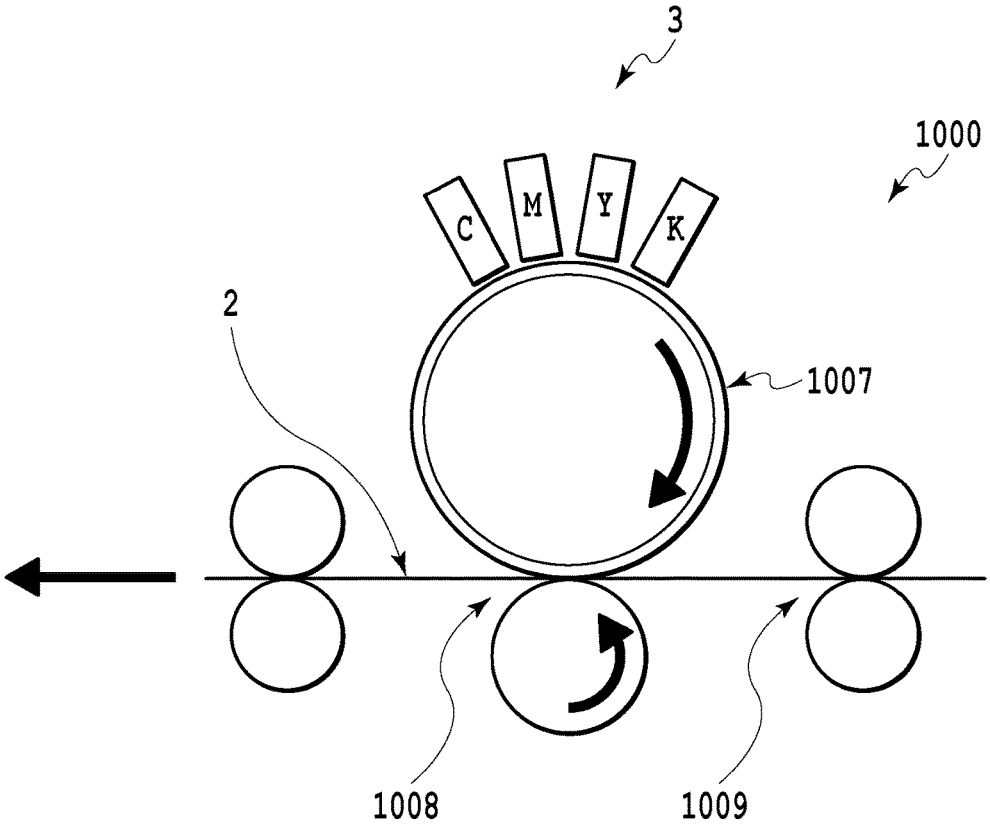
FIG. 33 is a diagram illustrating a printing apparatus according to a third application example.

FIG. 33 is a schematic diagram illustrating an inkjet printing apparatus according to the application example. The printing apparatus 1000 has a configuration in which an image is not directly printed on a print medium by the liquid ejected from the liquid ejection head 3.

That is, the liquid is first ejected to an intermediate transfer member (an intermediate transfer drum 1007) to form an image thereon and the image is transferred to the print medium 2. In the printing apparatus 1000, the liquid ejection heads 3 respectively corresponding to four colors (CMYK) of inks are disposed along the intermediate transfer drum 1007 in a circular-arc shape. Accordingly, a full-color printing process is performed on the intermediate transfer member, the printed image is appropriately dried on the intermediate transfer member, and the image is transferred to the print medium 2 conveyed by a sheet conveying roller 1009 in terms of a transfer portion 1008. The sheet conveying system of the second application example is mainly used to convey a cut sheet in the horizontal direction. However, the application example can be also applied to a continuous sheet supplied from a main roll (not illustrated). In such a drum conveying system, since the sheet is conveyed while a predetermined tension is applied thereto, a conveying jam hardly occurs even at a high-speed printing operation. For this reason, the reliability of the apparatus is improved and thus the apparatus is suitable for a commercial printing purpose. Similarly to the first and second application examples, the supply system of the printing apparatus 1000, the buffer tank 1003, and the main tank 1006 are fluid-connected to each liquid ejection head 3. Further, an electrical control unit which transmits an ejection control signal and power to the liquid ejection head 3 is electrically connected to each liquid ejection head 3.

(Description of Fourth Circulation Mode)

Figure 34:
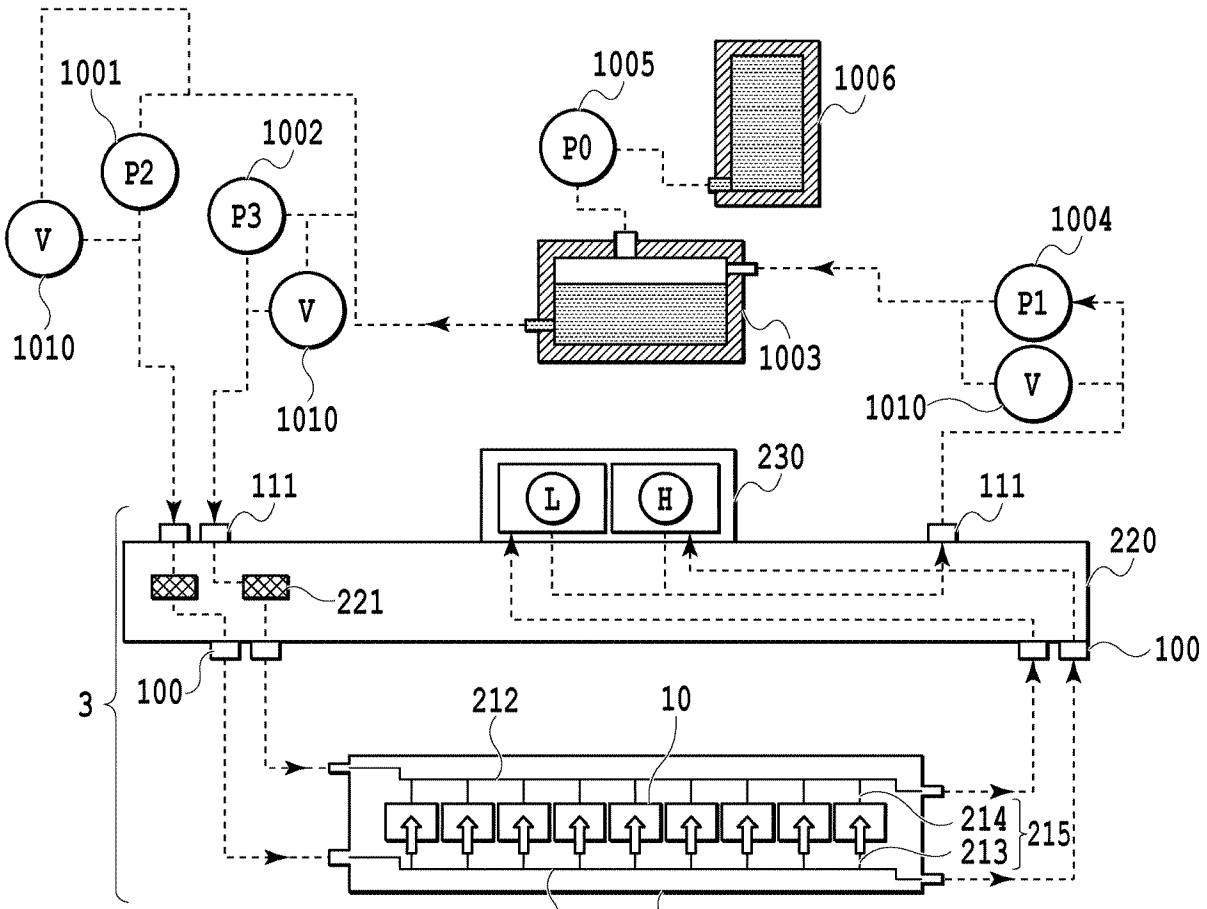
FIG. 34 is a diagram illustrating a fourth circulation mode.

Similarly to the second application example, the first and second circulation paths illustrated in FIG. 2 or can be also applied as the liquid circulation path between the liquid ejection head 3 and the tank of the printing apparatus 1000, but the circulation path illustrated in FIG. 34 is desirable. A main difference from the second circulation path of FIG. 3 is that a bypass valve 1010 is additionally provided to communicate with each of the passages of the first circulation pumps 1001 and 1002 and the second circulation pump 1004. The bypass valve 1010 has a function (a first function) of decreasing the upstream pressure of the bypass valve 1010 by opening the valve when a pressure exceeds a predetermined pressure. Further, the bypass valve has a function (a second function) of opening and closing the valve at an arbitrary timing by a signal from a control substrate of the printing apparatus body.

By the first function, it is possible to suppress a large or small pressure from being applied to the downstream side of the first circulation pumps 1001 and 1002 or the upstream side of the second circulation pump 1004. For example, when the functions of the first circulation pumps 1001 and 1002 are not operated properly, there is a case in which a large flow rate or pressure may be applied to the liquid ejection head 3. Accordingly, there is concern that the liquid may leak from the ejection opening of the liquid ejection head 3 or each bonding portion inside the liquid ejection head 3 may be broken. However, when the bypass valves are added to the first circulation pumps 1001 and 1002 as in the application example, the bypass valve 1010 is opened in the event of a large pressure. Accordingly, since the liquid path is opened to the upstream side of each circulation pump, the above-described trouble can be suppressed.

Further, when the circulation driving operation is stopped, all bypass valves 1010 are promptly opened on the basis of the control signal of the printing apparatus body after the operation of the first circulation pumps 1001 and 1002 and the second circulation pump 1004 are stopped by the second function. Accordingly, a high negative pressure (for example, several to several tens of kPa) at the downstream portion (between the negative pressure control unit 230 and the second circulation pump 1004) of the liquid ejection head 3 can be released within a short time. When a displacement pump such as a diaphragm pump is used as the circulation pump, a check valve is normally built inside the pump. However, when the bypass valve is opened, the pressure at the downstream portion of the liquid ejection head 3 can be also released from the downstream buffer tank 1003. Although the pressure at the downstream portion of the liquid ejection head 3 can be released only from the upstream side, pressure loss exists in the upstream passage of the liquid ejection head and the passage inside the liquid ejection head. For that reason, since some time is taken when the pressure is released, the pressure inside the common passage inside the liquid ejection head 3 transiently decreases too much. Accordingly, there is concern that the meniscus of the ejection opening may be broken. However, since the downstream pressure of the liquid ejection head is further released when the bypass valve 1010 at the downstream side of the liquid ejection head 3 is opened, the risk of the breakage of the meniscus of the ejection opening is reduced.

(Description of Structure of Liquid Ejection Head)

Figure 35A:
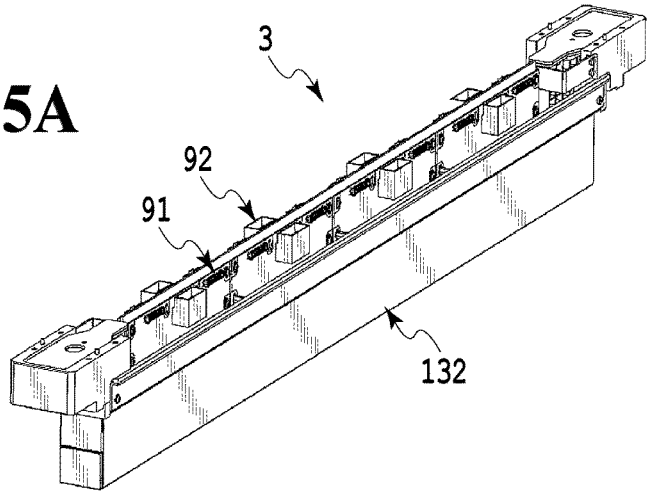
FIG. 35A is a diagram illustrating a liquid ejection head according to the third application example.
Figure 35B:
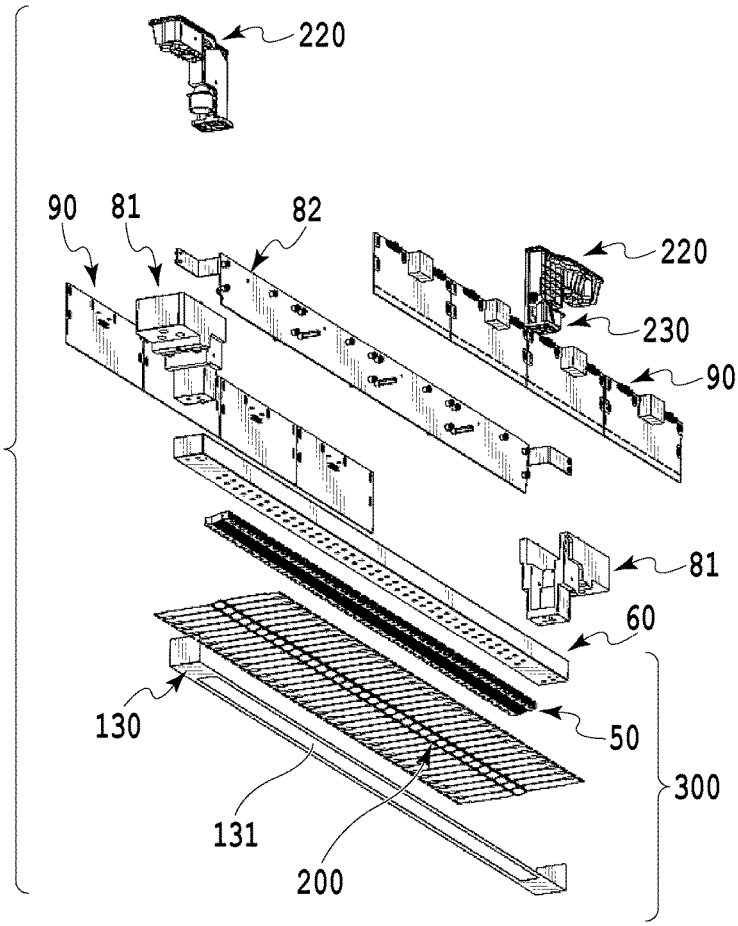
FIG. 35B is a diagram illustrating the liquid ejection head according to the third application example.

A structure of the liquid ejection head 3 according to the third application example of the invention will be described. FIG. 35A is a perspective view illustrating the liquid ejection head 3 according to the application example and FIG. 35B is an exploded perspective view thereof. The liquid ejection head 3 is an inkjet page wide type printing head which includes thirty six print element boards 10 arranged in a linear shape (an in-line shape) in the longitudinal direction of the liquid ejection head 3 and prints an image by one color. Similarly to the second application example, the liquid ejection head 3 includes a shield plate 132 which protects a rectangular side face of the head in addition to the signal input terminal 91 and the power supply terminal 92.

FIG. 35B is an oblique exploded view illustrating the liquid ejection head 3 and components or units constituting the liquid ejection head 3 according to the functions thereof (where the shield plate 132 is not illustrated). The functions of the units and the members or the liquid circulation sequence inside the liquid ejection head 3 are similar to those of the second application example. A main difference from the second application example is that the divided electric wiring boards 90 and the negative pressure control unit 230 are disposed at different positions and the first passage member has a different shape. As in the application example, for example, in the case of the liquid ejection head 3 having a length corresponding to the print medium of a B2 size, the power consumed by the liquid ejection head 3 is large and thus eight electric wiring boards 90 are provided. Four electric wiring boards 90 are attached to each of both side faces of the elongated electric wiring board support portion 82 attached to the liquid ejection unit support portion 81.

Figure 36A:
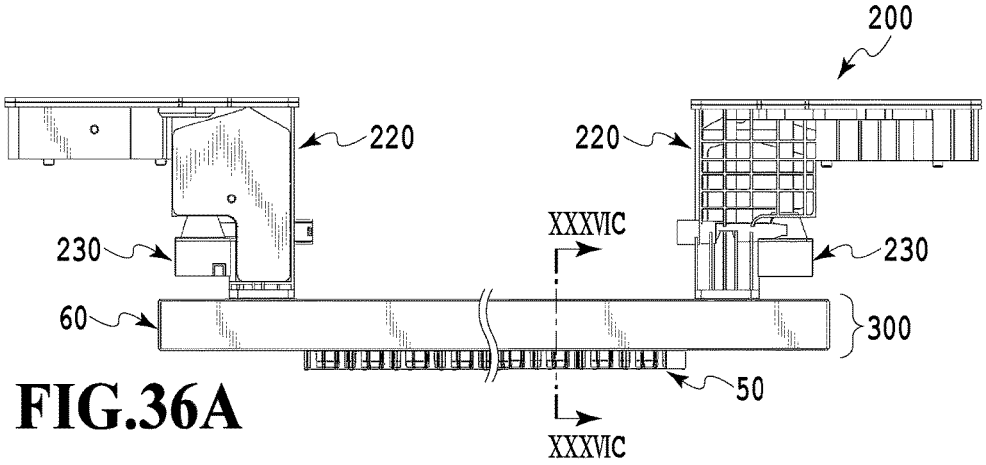
FIG. 36A is a diagram illustrating the liquid ejection head according to the third application example.
Figure 36B:
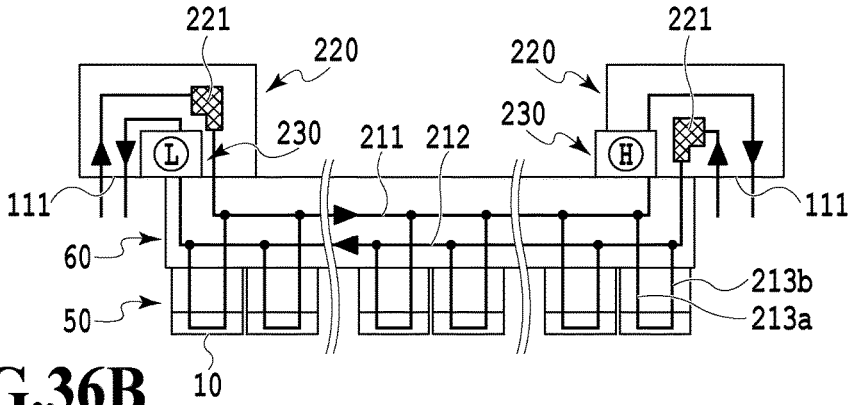
FIG. 36B is a diagram illustrating the liquid ejection head according to the third application example.
Figure 36C:
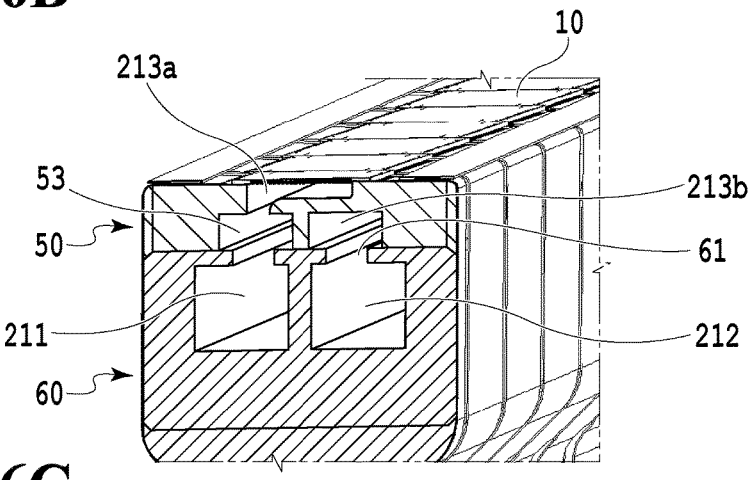
FIG. 36C is a diagram illustrating the liquid ejection head according to the third application example.

FIG. 36A is a side view illustrating the liquid ejection head 3 including the liquid ejection unit 300, the liquid supply unit 220, and the negative pressure control unit 230, FIG. 36B is a schematic diagram illustrating a flow of the liquid, and FIG. 36C is a perspective view illustrating a cross-section taken along a line XXXVIC-XXXVIC of FIG. 36A. In order to easily understand the drawings, a part of the configuration is simplified.

The liquid connection portion 111 and the filter 221 are provided inside the liquid supply unit 220 and the negative pressure control unit 230 is integrally formed at the lower side of the liquid supply unit 220. Accordingly, a distance between the negative pressure control unit 230 and the print element board 10 in the height direction becomes short compared with the second application example. With this configuration, the number of the passage connection portions inside the liquid supply unit 220 decreases. As a result, there is an advantage that the reliability of preventing the leakage of the printing liquid is improved and the number of components or steps decreases. Further, since a water head difference between the negative pressure control unit 230 and the ejection opening forming face decreases relatively, this configuration can be suitably applied to the printing apparatus in which the inclination angle of the liquid ejection head 3 illustrated in FIG. 33 is different for each of the liquid ejection heads. Since the water head difference can be decreased, a difference in negative pressure applied to the ejection openings of the print element boards can be reduced even when the liquid ejection heads 3 having different inclination angles are used. Further, since a distance from the negative pressure control unit 230 to the print element board 10 decreases, a flow resistance therebetween decreases. Accordingly, a difference in pressure loss caused by a change in flow rate of the liquid decreases and thus the negative pressure can be more desirably controlled.

FIG. 36B is a schematic diagram illustrating a flow of the printing liquid inside the liquid ejection head 3. Although the circulation path is not similar to the circulation path illustrated in FIG. 34 in terms of the circuit thereof, FIG. 36B illustrates a flow of the liquid in the components of the actual liquid ejection head 3. A pair of the common supply passage 211 and the common collection passage 212 extending in the longitudinal direction of the liquid ejection head 3 is provided inside the elongated second passage member 60. The common supply passage 211 and the common collection passage 212 are formed so that the liquid flow therein in the opposite directions and the filter 221 is provided at the upstream side of each passage so as to trap foreign materials intruding from the connection portion 111 or the like. In this way, since the liquid flows through the common supply passage 211 and the common collection passage 212 in the opposite directions, a temperature gradient inside the liquid ejection head 3 in the longitudinal direction can be desirably reduced. In order to simplify the description of FIG. 34, the flows in the common supply passage 211 and the common collection passage 212 are indicated by the same direction. The negative pressure control unit 230 is connected to the downstream side of each of the common supply passage 211 and the common collection passage 212. Further, a branch portion is provided in the course of the common supply passage 211 to be connected to the individual supply passages 213*a* and a branch portion is provided in the course of the common collection passage 212 to be connected to the individual collection passages 213*b*. The individual supply passage 213*a* and the individual collection passage 213*b* are formed inside the first passage members 50 and each individual supply passage communicates with the opening 21 (see part (c) of FIG. 20) of the lid member 20 provided at the rear face of the print element board 10.

The negative pressure control units 230 indicated by "H" and "L" of FIG. 36B are units at the high pressure side (H) and the low pressure side (L). The negative pressure control units 230 are back pressure type pressure adjustment mechanisms which control the upstream pressures of the negative pressure control units 230 to a high negative pressure (H) and a low negative pressure (L). The common supply passage 211 is connected to the negative pressure control unit 230 (the high pressure side) and the common collection passage 212 is connected to the negative pressure control unit 230 (the low pressure side) so that a differential pressure is generated between the common supply passage 211 and the common collection passage 212. By the differential pressure, the liquid flows from the common supply passage 211 to the common collection passage 212 while sequentially passing through the individual supply passage 213*a*, the ejection opening 13 (the pressure chamber 23) in the print element board 10, and the individual collection passage 213*b*.

FIG. 36C is a perspective view illustrating a cross-section taken along a line XXXVIC-XXXVIC of FIG. 36A. In the application example, each ejection module 200 includes the first passage member 50, the print element board 10, and the flexible circuit board 40. In the embodiment, the support member 30 (FIG. 18) described in the second application example does not exist and the print element board 10 including the lid member 20 is directly bonded to the first passage member 50. The liquid is supplied from the communication opening 61 formed at the upper face of the common supply passage 211 provided at the second passage member to the individual supply passage 213*a* through the individual communication opening 53 formed at the lower face of the first passage member 50. Subsequently, the liquid passes through the pressure chamber 23 and passes through the individual collection passage 213*b*, the individual communication opening 53, and the communication opening 61 to be collected to the common collection passage 212.

Here, differently from the second application example illustrated in FIG. 15, the individual communication opening 53 formed at the lower face of the first passage member 50 (the face near the second passage member 60) is sufficiently large with respect to the communication opening 61 formed at the upper face of the second passage member 50. With this configuration, since the first passage member and the second passage member reliably fluid-communicate with each other even when a positional deviation occurs when the ejection module 200 is mounted onto the second passage member 60, the yield in the head manufacturing process is improved and thus a decrease in cost can be realized.

In addition, the description of the above-described application example does not limit the scope of the invention. As an example, in the application example, a thermal type has been described in which bubbles are generated by a heating element to eject the liquid. However, the invention can be also applied to the liquid ejection head which employs a piezo type and the other various liquid ejection types.

In the application example, the inkjet printing apparatus (the printing apparatus) has been described in which the liquid such as ink is circulated between the tank and the liquid ejection head, but the other application examples may be also used. In the other application examples, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the application example, an example of using a so-called line type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the invention is not limited thereto. That is, a liquid ejection head which is shorter than the width of the print medium and includes a plurality of print element boards disposed so that the ejection openings overlap each other in the ejection opening row direction may be provided and the print medium may be scanned by the liquid ejection head.

First Embodiment

Hereinafter, a first embodiment of the invention will be described with reference to the drawings. Further, since a basic configuration of the embodiment is similar to that of the first application example, only characteristic points will be described below.

Figure 22A:
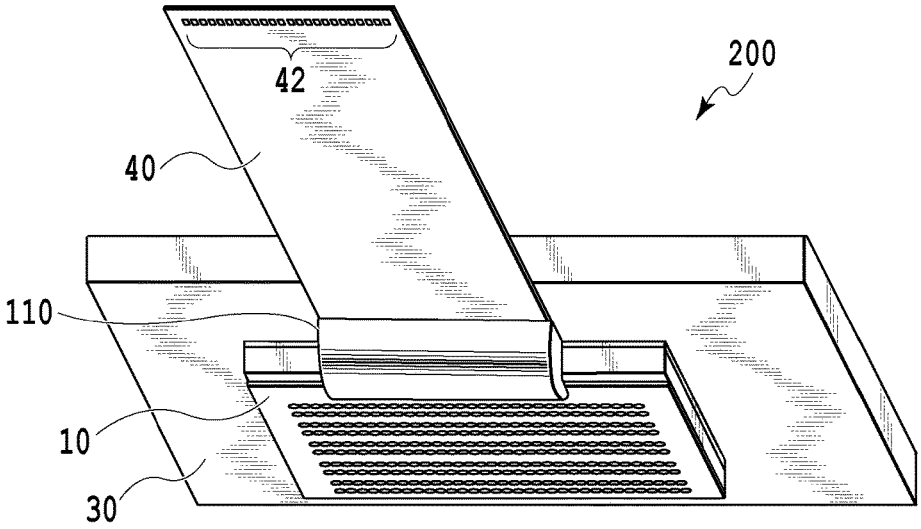
FIG. 22A is a diagram illustrating a liquid ejection module of the printing apparatus.
Figure 22B:
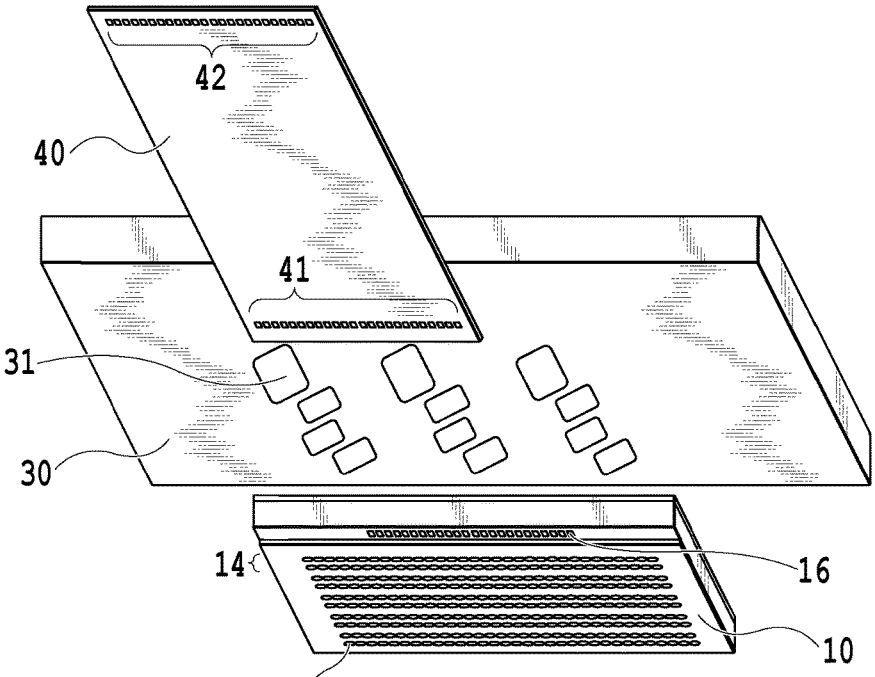
FIG. 22B is a diagram illustrating the liquid ejection module of the printing apparatus.

FIG. 22A is a perspective view illustrating the liquid ejection module 200 of the embodiment the printing apparatus 1000. The liquid ejection module 200 has a configuration in which the print element board 10 and the flexible circuit board 40 are disposed on the support member 30. FIG. 22B is an exploded perspective view illustrating the liquid ejection module 200. The terminal 16 of the print element board 10 and the terminal 41 of the flexible circuit board 40 are electrically connected to each other through a metal wire (not illustrated) and the connection portion is covered by the sealing member 110 to be protected. The support member 30 is provided with the liquid communication opening 31 which supplies the ink ejected from the liquid ejection module 200 to the print element board 10. It is desirable that the support member have high flatness and sufficiently high reliability while being bonded to the print element board 10. As a material, for example, alumina or resin is desirable.

Figure 23A:
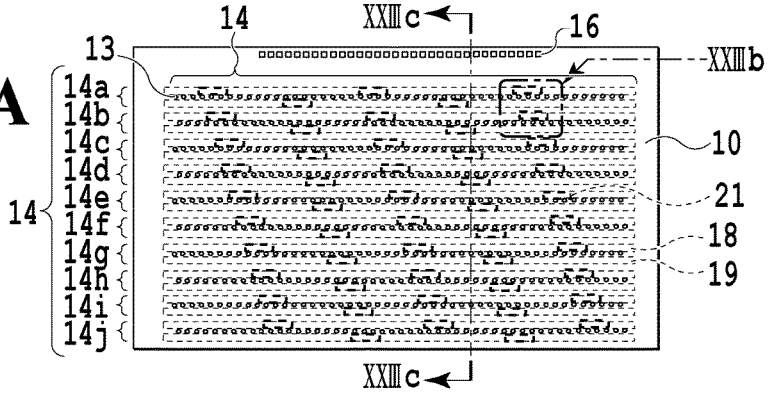
FIG. 23A is a diagram illustrating a structure of a print element board.
Figure 23B:
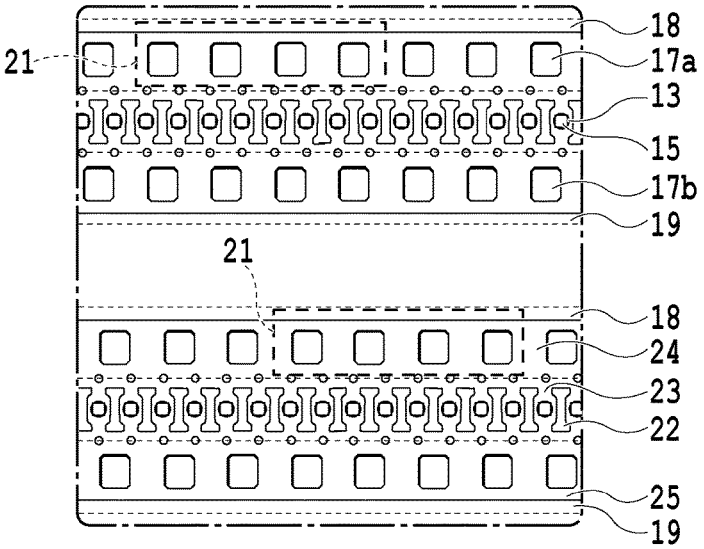
FIG. 23B is a diagram illustrating the structure of the print element board.
Figure 23C:
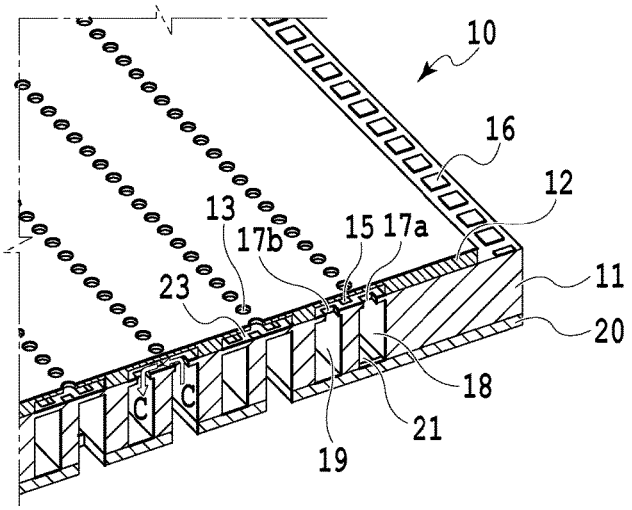
FIG. 23C is a diagram illustrating the structure of the print element board.

FIGS. 23A to 23C are diagrams illustrating a structure of the print element board 10. FIG. 23A illustrates an entire outline of the print element board 10, FIG. 23B is an enlarged view illustrating a part XXIIIB of FIG. 23A and illustrating a state where the liquid passes through the ejection opening forming member 12 in order to easily describe the drawing, and FIG. 23C is a cross-sectional view taken along a line XXIIIC-XXIIIC of FIG. 23A. The ejection opening forming member 12 of the print element board 10 is provided with a plurality of ejection opening rows corresponding to different ink colors. The print element 15 which is a heating element that changes the liquid into bubbles by heat energy is disposed at a position corresponding to each ejection opening 13 in the substrate 11 of the print element board 10.

In addition, the extension direction of the ejection opening row having the ejection openings 13 arranged therein will be referred to as the "ejection opening row direction". In the substrate 11, the pressure chamber 23 having the print element 15 provided therein is defined by the partition wall 22. The print element 15 is electrically connected to the terminal 16 of FIG. 23A by an electric wire (not illustrated) provided in the print element board 10 and is heated by a pulse signal input from the control circuit of the printing apparatus 1000 through the flexible circuit board 40 to boil the liquid. The liquid is ejected from the ejection opening 13 by a foaming force caused by the boiling.

Furthermore, the sheet-shaped lid member 20 (see FIG. 23C) is laminated on a rear face of a face provided with the ejection opening 13 of the print element board 10 and the lid member 20 is provided with the openings 21 (the supply openings 21) communicating with the liquid supply path 18 to be described later. In the embodiment, three openings 21 are provided in the lid member 20 to correspond to one liquid supply path 18. Further, the openings 21 of the lid member 20 respectively communicate with the liquid communication openings 31 of FIG. 22B. Further, the lid member 20 forms a part of a wall of the liquid supply path 18 formed in the substrate 11 of the print element board 10 and specifically serves as a lid of the liquid supply path 18.

Further, it is desirable that the lid member 20 have sufficient corrosion resistance for the liquid. Further, from the viewpoint of preventing the mixed color, the opening shape and the opening position of the opening 21 need to be formed with high accuracy. For this reason, it is desirable to form the opening 21 by using a photosensitive resin material or a silicon plate as a material of the lid member 20 through photolithography. Further, the lid member 20 changes the pitch of the passages by the opening 21. Here, it is desirable to form the lid member by a film-shaped member with a thin thickness in consideration of pressure loss. In consideration of the description above, the lid member 20 is desirably formed as a photosensitive thin resin film member.

In the embodiment, the ink inside the pressure chamber is circulated to the outside. By employing such a configuration, the flow of the ink can be generated in the pressure chamber or the ejection opening that is not used for a printing operation when the liquid ejection head 3 prints an image. Accordingly, the thickening of the ink at that portion can be suppressed. Further, the thickened ink or the foreign material in the ink can be discharged to the outside of the liquid ejection module 200. For this reason, the liquid ejection head 3 of the embodiment can print a high-quality image at a higher speed.

First, a configuration in which the ink is circulated inside the ejection opening of the embodiment will be described. As illustrated in FIG. 23A, the liquid supply path 18 extends at one side and the liquid collection path 19 extends at the other side along the ejection opening rows 14*a* to 14*j*. That is, each ejection opening row is interposed between the liquid supply path 18 and the liquid collection path 19. The liquid supply path and the liquid collection path 19 respectively communicate with the pressure chamber through the supply opening 17*a* and the collection opening 17*b*. The liquid supply path 18, the liquid collection path 19, the supply opening 17*a*, and the collection opening 17*b* are formed on the substrate 11 formed of Si.

In the embodiment, the lid member 20 is provided with three openings 21 (the supply openings) which are provided for each liquid supply path 18 and two openings 21 (the collection openings) which are provided for each liquid collection path 19. The openings 21 of the lid member 20 communicate with the liquid communication openings 31 (see FIG. 22B) of the support member 30. In the specification, the invention is not limited thereto. At least one opening 21 may be provided for each of the liquid supply path 18 and the liquid collection path 19.

Next, a flow of the liquid inside the print element board 10 will be described. The print element board 10 is obtained by laminating the substrate 11 formed of Si and the ejection opening forming member 12 formed of photosensitive resin and the lid member 20 is bonded to a rear face of the substrate 11. In the embodiment, the lid member 20 and the substrate 11 are bonded to each other without an adhesive. One face of the substrate 11 is provided with the print element 15 and a rear face thereof is provided with grooves forming the liquid supply path 18 and the liquid collection path 19 extending along the ejection opening row 14. The rear face is provided with the lid member 20 and the lid is attached to the groove to form each liquid path. The liquid supply path 18 and the liquid collection path 19 which are formed by the substrate 11 and the lid member 20 are respectively connected to a common supply passage and a common collection passage (not illustrated) inside the passage member 50 (see FIG. 6) and a differential pressure is generated between the liquid supply path 18 and the liquid collection path 19.

When the liquid is ejected from the ejection openings 13 of the liquid ejection head 3 to print an image, the liquid inside the liquid supply path 18 at the ejection opening that does not perform an ejection operation flows to the liquid collection path 19 through the supply opening 17*a*, the pressure chamber 23, and the collection opening 17*b* by the differential pressure (a flow in a direction indicated by an arrow C of FIG. 23C). By the flow, foreign materials, bubbles, and thickened ink produced by the evaporation from the ejection opening 13 in the ejection opening 13 or the pressure chamber 23 not involved with a printing operation can be collected to the liquid collection path 19. Further, the thickening of the ink of the ejection opening 13 or the pressure chamber 23 can be suppressed.

The liquid which is collected by the liquid collection path 19 is collected to the outside of the liquid ejection module 200 through the opening 21 (the collection opening) of the lid member 20 and the liquid communication opening 31 of the support member 30 and is finally collected by the supply path of the printing apparatus. That is, the liquid which is supplied from the printing apparatus body to the liquid ejection module 200 flows to be supplied and collected according to the following sequence. First, the liquid is supplied to the pressure chamber 23 while sequentially flowing through the liquid communication opening 31 provided in the support member 30, the opening 21 (the supply opening) provided in the lid member 20, and the liquid supply path 18 and the supply opening 17*a* provided in the substrate 11. In the liquid which is supplied to the pressure chamber 23, the liquid which is not ejected from the ejection opening 13 flows to the outside of the liquid ejection module 200 while sequentially flowing through the collection opening 17*b* and the liquid collection path 19, the opening 21 (the supply opening) provided in the lid member 20, and the liquid communication opening 31 provided in the support member 30.

In this way, in the liquid ejection module 200 of the embodiment, the thickening of the liquid in the vicinity of the pressure chamber 23 or the ejection opening 13 can be suppressed. Accordingly, a slippage or a non-ejection can be suppressed. As a result, a high-quality image can be printed.

Figure 24A:
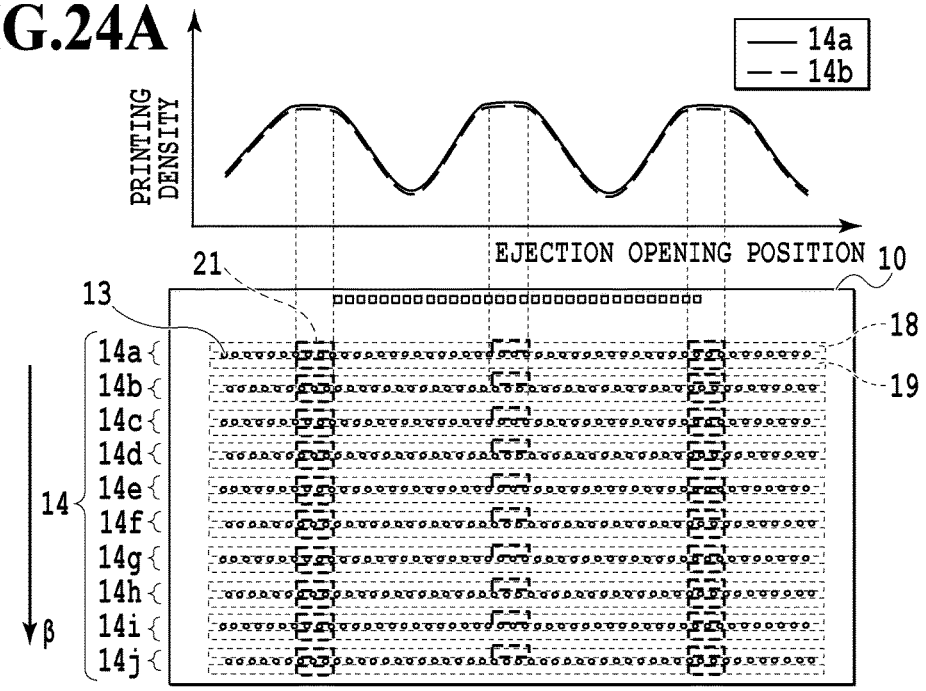
FIG. 24A is a diagram illustrating a relation between a position of an opening of a lid member and corresponding printing density.

Here, characteristics of the invention will be described with reference to the drawings and a comparative example. FIG. 24A is a diagram illustrating a relation of the ejection opening row of the print element board and the opening of the lid member of a comparative example with respect to corresponding printing density. In the comparative example, the openings 21 of the lid member are disposed at the same position in the ejection opening rows along the ejection opening row direction. In such a configuration, since the negative pressures at the ejection openings on the same line in the print medium conveying direction (a direction indicated by an arrow β) in all rows of the ejection opening rows 14*a* to 14*j* are substantially the same, printing density is relatively high at the ejection opening (the vicinity of the opening) having a low negative pressure and printing density is relatively low at the ejection opening having a high negative pressure. That is, since the high printing density position and the low printing density position are provided in each ejection opening row as illustrated in a graph of FIG. 24A, the shape in the printing is emphasized on the print medium and thus unevenness in printing is easily recognized.

Figure 24B:
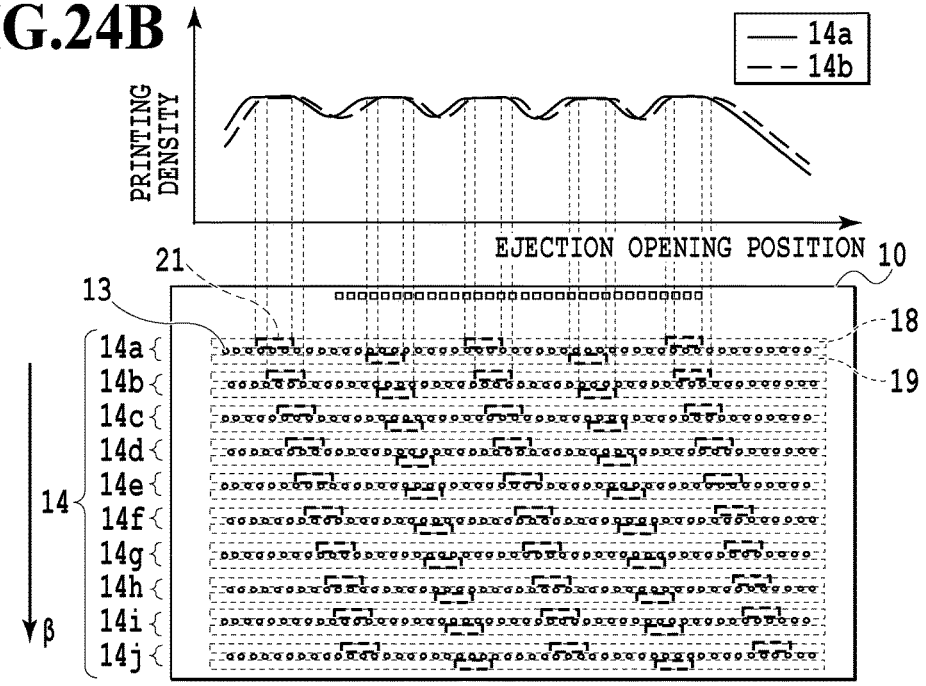
FIG. 24B is a diagram illustrating a relation between the position of the opening of the lid member and the corresponding printing density.

Here, in the invention, the opening 21 of the lid member 20 is disposed as below. FIG. 24B is a diagram illustrating a relation of the ejection opening row of the print element board 10 and the opening 21 of the lid member 20 of the embodiment with respect to corresponding printing density. The liquid ejection module 200 of the embodiment has a configuration in which the center (gravity center) positions of the openings 21 of the lid member 20 are not arranged on the same line of a direction (the print medium conveying direction (the direction indicated by the arrow β)) substantially orthogonal to the arrangement direction of the ejection openings among the ejection opening rows 14. Specifically, the center positions of the openings 21 are arranged on the same line forming a predetermined angle with respect to a direction substantially orthogonal to the arrangement direction of the ejection openings in the ejection opening row. In this way, since a printing density distribution is set to be different depending on the positions of the ejection opening rows 14*a* to 14*j*, the shape of the printing density is reduced and thus is not easily recognized. Thus, printing quality when an image is printed on the print medium can be improved.

Additionally, in the specification, an effect can be obtained when the center position of at least one opening 21 in the ejection opening rows is not disposed on the same line in the print medium conveying direction without causing a deviation of the centers of all openings 21 on the line.

Here, in the embodiment, the ink refill flow to the pressure chamber 23 generated after the ejection of the ink becomes stronger than the flow circulated through the pressure chamber in a short time. For this reason, the supply opening 21 and the collection opening 21 exist in the openings 21, but the ink refill flow to the pressure chamber 23 generated after the ejection of the ink is instantly generated at both the supply side and the collection side even in the case of the circulation. At that time, the negative pressure is low at the ejection opening near the opening 21 and the negative pressure at the ejection opening becomes higher as it goes away from the opening 21.

Thus, as in the printing density distribution illustrated in FIG. 24B, the printing density is high in the vicinity of the opening 21 regardless of any one of the supply opening 21 and the collection opening 21 and the printing density becomes lower as it goes away from the opening 21. Thus, since the center position of the opening 21 (the supply side) of the ejection opening row 14 and the center position of the collection opening 21 of the same ejection opening row 14 are not arranged on the same line in the print medium conveying direction, the high printing density portions on the print medium can be distributed. In order to further exhibit such an effect, it is desirable that the center position of the supply opening 21 or the collection opening 21 is not arranged on the same line in the print medium conveying direction even among different ejection opening rows 14. At that time, the center positions of the openings 21 at the supply side and the collection side may not be arranged on the same line in the print medium conveying direction as illustrated in FIGS. 24A and 24B.

In addition, since the support member 30 has a function of the lid member 20, the invention can be also applied to a structure without the lid member 20.

In this way, the openings of the ejection opening rows are disposed so that the center (gravity center) position of at least one opening is not arranged on the same line extending in the print medium movement direction in the relative movement with respect to the center positions of the other openings. Accordingly, the liquid ejection module capable of suppressing unevenness in printing and the liquid ejection head including the same can be realized.

Second Embodiment

Hereinafter, a second embodiment of the invention will be described with reference to the drawings. Further, since a basic configuration of the embodiment is similar to that of the first application example, only characteristic points will be described below.

Figure 25A:
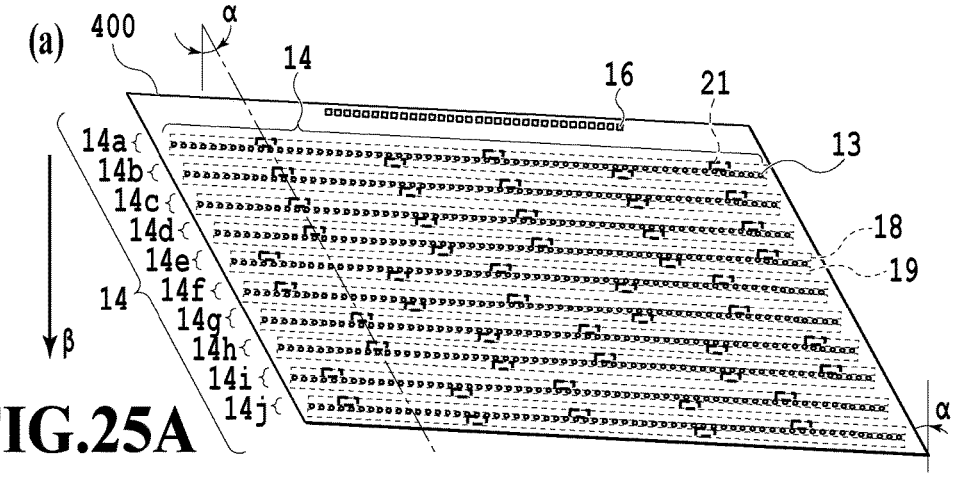
FIG. 25A is a diagram illustrating a liquid ejection module and a liquid ejection head of the printing apparatus.
Figure 25B:
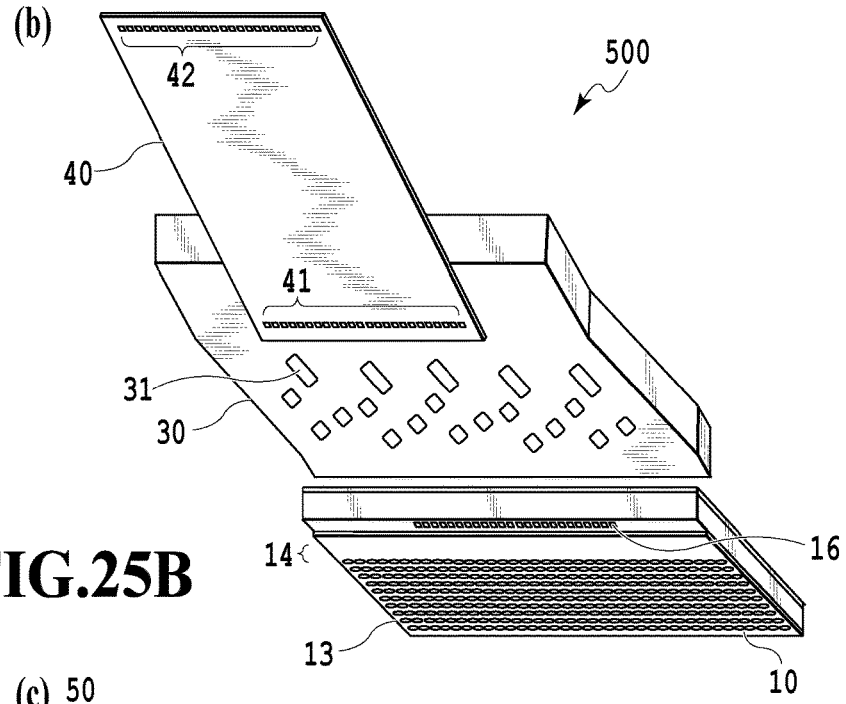
FIG. 25B is a diagram illustrating the liquid ejection module and the liquid ejection head of the printing apparatus.
Figure 25C:
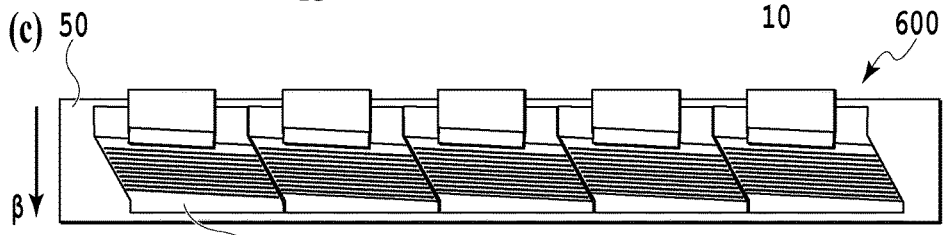
FIG. 25C is a diagram illustrating the liquid ejection module and the liquid ejection head of the printing apparatus.

FIG. 25A is a diagram illustrating a print element board 400 of the embodiment, FIG. 25B is an exploded perspective view illustrating a liquid ejection module 500, and FIG. 25C is a diagram illustrating a liquid ejection head 600 in which the liquid ejection modules 500 are arranged.

In a configuration of the first embodiment, the longest distance from the opening 21 to the ejection opening 13 becomes different among the ejection opening rows. For example, as understood from FIG. 23A, the ejection opening row 14*a* is long from a comparison between a distance between the opening 21 and the ejection opening 13 at the right end of the drawing of the ejection opening row 14*a* and a distance between the opening 21 and the ejection opening 13 at the right end of the drawing of the ejection opening row 14*e*. In such a configuration, since the negative pressure is high at the ejection opening 13 far from the opening 21, the ink is supplied at a late timing when an image is printed at a high speed and thus a non-ejection may be caused. Accordingly, there is concern that printing quality may be deteriorated.

Here, in the embodiment, the number of the openings 21 corresponding to the ejection opening rows 14 is not changed and the longest distance from the opening 21 of each ejection opening row 14 to the ejection opening 13 is set to be substantially the same. In the embodiment, as illustrated in FIG. 25A, the center of the opening 21 through which the same liquid flows in each ejection opening row 14 is disposed on the same line forming a predetermined angle α (α>0) with respect to the print medium conveying direction and the outer shape of the print element board is formed in a substantially parallelogram shape having a side forming a predetermined angle α with respect to the print medium conveying direction. As illustrated in FIG. 25A, the parallelogram shape of the embodiment is a shape in which an angle formed by the adjacent sides of the outer shape of the print element board 400 is not 90°. The outer shapes (sides) of both ends of the print element board 400 in the ejection opening row direction are substantially parallel to the ejection opening row and the outer shapes of the other two sides are substantially parallel to a line connecting the centers of the openings 21 through which the same liquid flows in a direction intersecting the ejection opening row. Further, the same line having a predetermined angle with respect to the print medium conveying direction is substantially parallel to the side which is not parallel to the ejection opening row of the print element board 400.

With such a structure, the ejection opening rows 14 can be formed such that the longest distance from the opening 21 to the ejection opening is substantially the same. In this way, since the longest distance is substantially the same in the ejection opening rows 14, the ink does not flow through the supply passage 18 in an extremely long distance, the pressure loss is also reduced and thus printing quality can be improved. Further, when the same supply passage 18 includes the openings 21, at least a distance from the end of the ejection opening row 14 to the opening 21 may be shorter than a gap between the openings 21 of the same supply passage 18 in the ejection opening row direction. When the openings are disposed in this way, the ink does not flow through the supply passage 18 in an extremely long distance and thus printing quality can be further improved.

In addition, as described above in the third embodiment, since the ink is also supplied from the collection passage 19 during the ejection operation, it is desirable to dispose the opening 21 of the collection passage 19 as well as the opening 21 of the supply passage 18.

Further, when the print element board is formed in a substantially parallelogram shape, the liquid ejection modules 200 can be arranged in a line in the longitudinal direction of the liquid ejection head 600 as illustrated in FIG. 25C. In the case of the line type liquid ejection head (the page wide type liquid ejection head) in which the liquid ejection modules 200 are arranged in a line, an image can be printed at a higher speed. At that time, printing quality can be desirably improved when the ejection openings of different ejection opening rows partially overlap each other at the connection portion of the liquid ejection modules 200. Since the ejection openings of different ejection opening rows partially overlap each other as in FIG. 25C, the ejection opening row of each print element board 10 is inclined by a predetermined angle with respect to the longitudinal direction of the liquid ejection head 600. In such a line head configuration, since one-pass printing operation is performed in many cases, the problem of the invention becomes severe and thus the effect of the invention can be easily obtained.

In addition, a configuration has been described in which many kinds of inks are supplied to one print element board 10, but the same effect can be obtained even when one kind of ink is supplied thereto. For example, in the liquid ejection head that prints an image at a high speed and is dedicated for a commercial printing purpose, one liquid ejection head is disposed for one kind of ink. However, when the liquid ejection module of such a liquid ejection head has the configuration of the invention, printing quality can be improved.

Third Embodiment

Hereinafter, a third embodiment of the invention will be described with reference to the drawings. Additionally, since a basic configuration of the embodiment is similar to that of the first application example, only characteristic points will be described below.

Figure 26A:
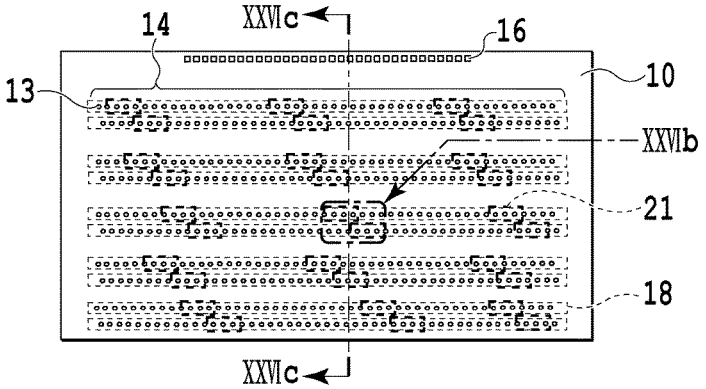
FIG. 26A is a diagram illustrating a structure of the print element board.
Figure 26B:
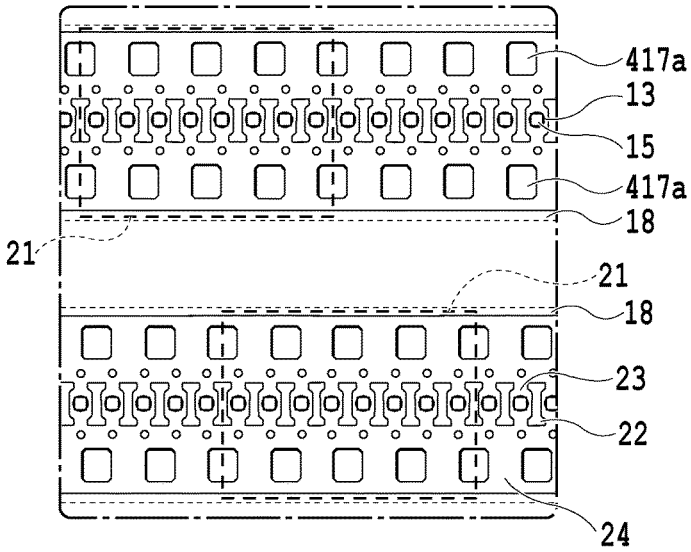
FIG. 26B is a diagram illustrating the structure of the print element board.
Figure 26C:
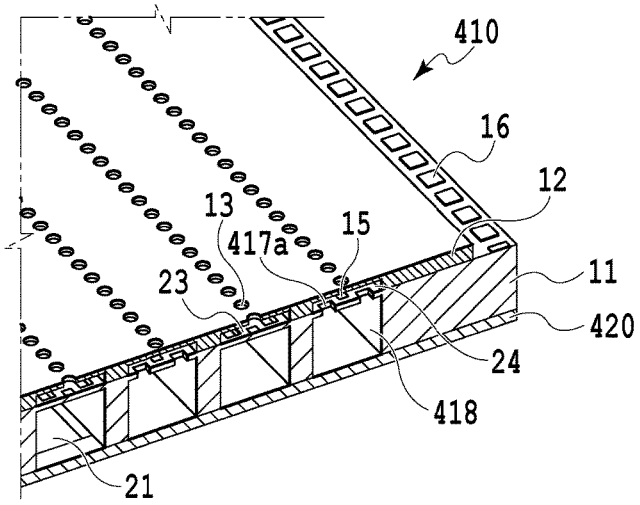
FIG. 26C is a diagram illustrating the structure of the print element board.

FIGS. 26A to 26C are diagrams illustrating a structure of the print element board 10. FIG. 26A illustrates an entire outline of the print element board 10, FIG. 26B is an enlarged view of a part XXVIB of FIG. 26A, and FIG. 26C is a cross-sectional view taken along a line XXVIC-XXVIC of FIG. 26A.

In the embodiment, a configuration of the passage that supplies the ink to the ejection opening is different from those of the above-described embodiments. In the above-described embodiments, a configuration has been described in which the passage supplying the ink to the ejection opening and the passage collecting the ink from the ejection opening are divided. However, in the embodiment, the ink is supplied from the liquid supply path 418 to the ejection opening without the circulation of the ink. The liquid supply path 418 is a passage which is provided in a print element board 410 and extends in the ejection opening row direction and communicates with the ejection opening 13 through a supply opening 417*a*. In the invention, as described above, the printing density increases in the vicinity of the opening 21 and the printing density decreases as it goes away from the opening 21 in a refill state regardless of the circulation, that is, the existence of the collection opening 21. Thus, the invention can be also applied to the liquid ejection head of the embodiment that does not perform the circulation.

Hereinafter, a flow of the liquid inside the liquid ejection module 200 will be described. The ink which is supplied from an ink supply source (not illustrated) first passes through the liquid communication opening 31 (see FIG. 22B) formed in the support member 30 inside the liquid ejection module 200 and flows into the liquid supply path 418 through the supply opening 21 of the lid member 420 of the print element board 410. At this time, in a general inkjet printing apparatus, inks of four colors including black, cyan, magenta, and yellow are used and are separately supplied according to each color. Furthermore, the printing apparatus 1000 of the embodiment includes four ejection opening rows for black and two ejection opening rows for the other colors.

The ink which flows into the liquid supply path 418 flows through the liquid supply path 418, flows into the common supply liquid chamber 24 through the supply opening 417*a*, and is divided into the pressure chambers 23. The ink which is supplied to each of the pressure chambers 23 is boiled by heat energy generated by the print element 15 to be ejected from the ejection opening 13 and is landed on a print medium (not illustrated) so that an image is printed thereon. When the supply opening 417*a* is disposed at both sides of the ejection opening row 14 as in the embodiment, the ink is supplied fast after the ejection of the ink and thus an image can be printed at a higher speed. In addition, even when the supply opening 417*a* is disposed only at one side, the invention can be applied to this configuration.

Figure 27A:
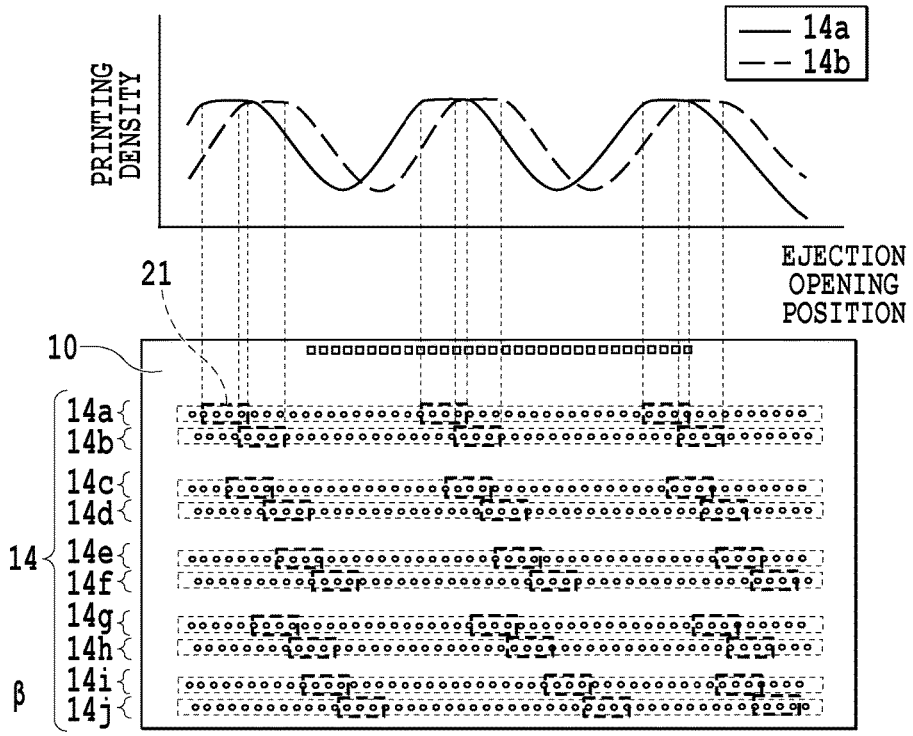
FIG. 27A is a diagram illustrating a relation between the position of the opening of the lid member and the corresponding printing density.

Here, characteristics of the invention will be described. In the embodiment, the openings of the lid member are disposed according to the following configuration. FIG. 27A is a diagram illustrating a relation between the ejection opening row of the print element board 410 and the opening position of the lid member 420 of the embodiment. In the embodiment, the opening 21 is disposed so that the center of the opening 21 of the lid member 420 does not exist on the same line in the conveying direction corresponding to the print medium conveying direction (the direction indicated by the arrow β). With such a configuration, since the ejection opening position having a high negative pressure in the ejection opening row direction and the ejection opening position having a low negative pressure in the ejection opening row direction are different in each ejection opening row, the high printing density position and the low printing density position in the ejection opening row direction are different in each ejection opening row. Accordingly, since the high printing density position and the low printing density position on the print medium are distributed in each ejection opening row, the shade on the print medium is reduced and thus is not easily recognized. As a result, printing quality can be improved.

In addition, in the embodiment, the center positions of the openings 21 of all lid members 420 are not arranged on the same line in the print medium conveying direction, but the invention is not limited thereto. That is, an effect of the invention can be obtained when at least one opening 21 is not disposed on the same line in the print medium conveying direction with respect to the openings 21 of the other ejection opening rows.

Further, a further effect can be obtained when the invention is applied to the ejection opening row 14 of the same color. Then, more effects can be obtained when the invention is applied to many ejection opening rows 14. For that reason, the openings 21 of the ejection opening row 14 are not desirably arranged on the same line in the print medium conveying direction as much as possible. Similarly to the embodiment, it is most desirable that the center positions of the openings 21 of all ejection opening rows 14 be arranged at different positions in the ejection opening row direction.

Figure 27B:
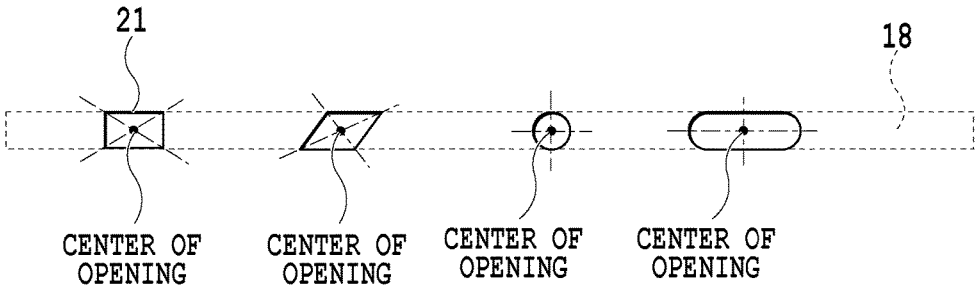
FIG. 27B is a diagram exemplifying openings having various shapes when viewed from the lid member.

In addition, in the above-described embodiments, a phrase of the center of the opening 21 has been used, but this phrase can be defined as the center of the shape of the opening 21. That is, FIG. 27B exemplifies openings having various shapes when viewed from the lid member 420. As illustrated in the drawings, the center of the opening indicates an intersection point in the case of a parallelogram opening, a center of a circle in the case of a circular opening, and two intersection points of a line-symmetrical symmetry axis in the case of a long round opening.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a divisional of U.S. patent application Ser. No. 15/388,725, filed Dec. 22, 2016, which claims the benefit of Japanese Patent Application No. 2016-002999 filed Jan. 8, 2016, and No. 2016-239695 filed Dec. 9, 2016, which are hereby incorporated by reference herein in their entirety.

What is claimed is:

1. A liquid ejection head of a page wide type comprising:

print element boards having ejection openings ejecting a liquid; and a support member on which a plurality of the print element boards are arranged in a first direction, the print element boards comprising:

pressure chambers having therein energy generating elements for generating energy used for ejecting the liquid from the ejection openings;

a liquid supply path provided along the first direction for supplying liquid to the plurality of pressure chambers;

a liquid collection path provided along the first direction for collecting liquid from the plurality of pressure chambers;

a supply port for supplying liquid to the liquid supply path; and a collection port for collecting liquid from the liquid collection path, wherein the center of gravity of the supply port and the center of gravity of the collection port are offset with respect to a second direction orthogonal to the first direction.

2. The liquid ejection head according to claim 1, wherein each of the print element boards has an ejection opening row in which the ejection openings are arranged along the first direction and the liquid supply path has a length equal to or longer than that of the ejection opening row.

3. The liquid ejection head according to claim 1, wherein each of the print element boards has an ejection opening row in which the ejection openings are arranged along the first direction and the liquid collection path has a length equal to or longer than that of the ejection opening row.

4. The liquid ejection head according to claim 1, wherein the plurality of print element boards are linearly arranged.

5. The liquid ejection head according to claim 1, wherein each of the print element boards has a supply opening for supplying liquid from the liquid supply path to the pressure chamber.

6. The liquid ejection head according to claim 1, wherein each of the print element boards has a collection opening for collecting liquid from the pressure chamber to the liquid collection path.

7. The liquid ejection head according to claim 1, wherein each of the print element boards includes a supply opening for supplying liquid from the liquid supply path to the pressure chamber and a collection opening for collecting liquid from the pressure chamber to the liquid collection path, and the liquid flows in the order of the supply port, the liquid supply path, the supply opening, the pressure chamber, the collection opening, the liquid collection path, and the collection port.

8. The liquid ejection head according to claim 1, wherein each of the print element boards includes:

a first ejection opening row in which the ejection openings are arranged and a second ejection opening row extending along the first ejection opening row, a first supply port and a first collection port corresponding to the first ejection opening row, and a second supply port and a second collection port corresponding to the second ejection opening row.

9. The liquid ejection head according to claim 8, wherein the center of gravity of each of the first supply port, the first collection port, the second supply port, and the second collection port is offset with respect to the second direction.

10. The liquid ejection head according to claim 1, wherein a plurality of supply ports are provided, and in the first direction, the collection port is disposed between the supply ports.

11. The liquid ejection head according to claim 1, wherein the liquid inside the pressure chambers is circulated to the outside of the pressure chambers.

12. The liquid ejection head according to claim 1, wherein the ejection openings are disposed on one surface side of the print element boards and the supply ports and the collection ports are disposed on the other surface side which is the rear surface of the one surface.

13. The liquid ejection head according to claim 1, wherein the support member includes a common supply flow path extending in the first direction and supplying liquid to the print element boards via the supply ports, and a common collection flow path extending in the first direction and collecting liquid from the print element boards via the collection ports.

14. The liquid ejection head according to claim 13, wherein the common supply flow path and the common collection flow path are disposed in juxtaposition with each other, and the plurality of print element boards are linearly arranged along the common supply flow path.

15. A page wide liquid ejection head for ejecting a liquid to a relatively moving print medium, comprising:

print element boards having ejection openings for ejecting the liquid; and a support member on which a plurality of the print element boards are arranged in an intersecting direction crossing a relative movement direction, the print element boards comprising:

pressure chambers having therein energy generating elements for generating energy used for ejecting the liquid from the ejection openings;

a liquid supply path provided along the intersecting direction for supplying liquid to the plurality of pressure chambers;

a liquid collection path provided along the intersecting direction for collecting liquid from the plurality of pressure chambers;

a supply port for supplying liquid to the liquid supply path; and a collection port for collecting liquid from the liquid collection path, wherein the center of gravity of the supply port and the center of gravity of the collection port are offset with respect to the relative movement direction.

16. The liquid ejection head according to claim 15, wherein each of the print element boards includes a supply opening for supplying liquid from the liquid supply path to the pressure chamber and a collection opening for collecting liquid from the pressure chamber to the liquid collection path, and the liquid flows in the order of the supply port, the liquid supply path, the supply opening, the pressure chamber, the collection opening, the liquid collection path, and the collection port.

17. The liquid ejection head according to claim 15, wherein each of the print element boards includes:

a first ejection opening row in which the ejection openings are arranged and a second ejection opening row extending along the first ejection opening row, a first supply port and a first collection port corresponding to the first ejection opening row, and a second supply port and a second collection port corresponding to the second ejection opening row.

18. The liquid ejection head according to claim 17, wherein the center of gravity of each of the first supply port, the first collection port, the second supply port, and the second collection port is offset with respect to the relative movement direction.

19. The liquid ejection head according to claim 15, wherein the support member includes a common supply flow path extending in the relative movement direction and supplying liquid to the print element boards via the supply ports, and a common collection passage extending in the relative movement direction and collecting liquid from the print element boards via the collection ports, and the plurality of print element boards are linearly arranged along the common supply flow path.

20. The liquid ejection head according to claim 15, wherein the liquid inside the pressure chambers is circulated to the outside of the pressure chambers.

* * * * *